US011812861B2

(12) United States Patent
Stojanovic et al.

(10) Patent No.: US 11,812,861 B2
(45) Date of Patent: Nov. 14, 2023

(54) COMFORT LAYER WITH LIQUID PODS AND METHOD OF MAKING SAME

(71) Applicant: L&P Property Management Company, South Gate, CA (US)

(72) Inventors: Heidi Stojanovic, Fort Smith, AR (US); Bruce W. Peterson, West Lake Hills, TX (US)

(73) Assignee: L&P Property Management Company, South Gate, CA (US)

( * ) Notice: Subject to any disclaimer, the term of this patent is extended or adjusted under 35 U.S.C. 154(b) by 63 days.

(21) Appl. No.: 17/481,562

(22) Filed: Sep. 22, 2021

(65) Prior Publication Data

US 2023/0092044 A1 Mar. 23, 2023

(51) Int. Cl.
*A47C 27/10* (2006.01)
*A47C 27/08* (2006.01)

(52) U.S. Cl.
CPC ..... *A47C 27/10* (2013.01); *A47C 27/085* (2013.01); *A47C 27/086* (2013.01); *A47C 27/088* (2013.01)

(58) Field of Classification Search
CPC ..... A47C 27/10; A47C 27/085; A47C 27/086; A47C 27/088; A47C 27/15; A47C 27/148; A47C 27/20; A61G 7/05738
See application file for complete search history.

(56) References Cited

U.S. PATENT DOCUMENTS 5,617,595 A * 4/1997 Landi ..... A61G 7/05784 428/116
5,836,027 A * 11/1998 Leventhal ..... A47C 27/20 5/713
8,171,585 B2 * 5/2012 Mead ..... A47C 27/085 5/655.4
9,943,173 B2 4/2018 Krtek et al.
9,968,202 B2 5/2018 Long
10,405,665 B2 9/2019 Long
10,624,466 B2 4/2020 Krtek et al.
10,624,467 B2 4/2020 Krtek et al.
10,667,615 B2 6/2020 Long
10,813,462 B2 10/2020 Long
10,973,339 B2 4/2021 Lisenbee et al.
11,103,084 B2 * 8/2021 Jewett ..... A47C 27/15
2018/0049914 A1 * 2/2018 Stewart ..... A61F 7/02
(Continued)

FOREIGN PATENT DOCUMENTS

EP 0968697 A1 * 1/2000 ..... A61G 7/057
WO WO-2019014215 A1 * 1/2019 ..... A61K 9/70

OTHER PUBLICATIONS

"Seam." Merriam-Webster, Merriam-Webster, www.merriam-webster.com/dictionary/seam.*

(Continued)

*Primary Examiner* — David R Hare
*Assistant Examiner* — Madison Emanski
(74) *Attorney, Agent, or Firm* — Wood Herron & Evans LLP

(57) ABSTRACT

A comfort layer for a bedding or seating product has liquid pods sandwiched between plies of fabric. The plies of fabric are joined with seams thereby creating pockets, at least one liquid pod being inside each pocket. Each seam joining opposed plies of fabric around each of the liquid pods of the comfort layer may be segmented or solid, depending upon the fabric and type of seam.

20 Claims, 23 Drawing Sheets

(56) References Cited

U.S. PATENT DOCUMENTS

| | | | | |
|---|---|---|---|---|
| 2019/0021514 | A1* | 1/2019 | Hamilton | A47C 27/085 |
| 2020/0260882 | A1* | 8/2020 | Chunglo | A47C 27/148 |
| 2020/0337478 | A1* | 10/2020 | Suchman | A47G 9/0246 |

OTHER PUBLICATIONS

"Gel Memory Foam Mattresses: Everything You Need To Know", "How Does Gel Memory Foam Mattresses work?", www.boxdropgreenvalley.com/gel-memory-foam-mattresses-guide/ (Year: 2021).*

* cited by examiner

COMFORT LAYER WITH LIQUID PODS AND METHOD OF MAKING SAME

TECHNICAL FIELD OF THE INVENTION

This invention relates to a comfort layer for bedding and seating products. More particularly, this invention relates to a comfort layer having hydrogel pods for use in seating or bedding products and the method of manufacturing such comfort layer.

BACKGROUND OF THE INVENTION

Comfort layers are commonly used in seating or bedding products above/below a core. The core may or may not include a pocketed spring assembly, a more traditional unpocketed spring assembly or one or more pieces of foam. U.S. Pat. Nos. 9,943,173; 9,968,202; 10,405,665; 10,667,615 and 10,813,462 disclose comfort layers made of pocketed mini coil springs sandwiched between plies of fabric. Each of these U.S. patents is fully incorporated by reference herein.

Reducing heat has been a common objective of different types of bedding or seating products such as mattresses. One type of mattress used to try to produce a cool sleeping surface is a waterbed. A waterbed comprises an outer vinyl cover or bladder filled with water. One disadvantage of waterbeds is the volume of water required to fill the bladder. Should the bladder break, the carpet and/or other parts of the room in which the waterbed breaks may be damaged. Another disadvantage of a waterbed is that motion created by one user is felt by the other user of the mattress. This is known in the bedding industry as motion transfer. To some users, the feel of a waterbed is desirable, but the motion transfer properties of a waterbed are undesirable.

It is therefore an objective of this invention to provide a comfort layer for a seating or bedding product, which has the same feel as a waterbed, but without as much liquid as required of a conventional waterbed.

Another objective of this invention is to provide a comfort layer for a seating or bedding product made, at least partially, with liquid, which imparts the feel of a waterbed to a bedding or seating product having a pocketed or unpocketed spring assembly.

It is another objective of this invention to provide a seating or bedding product, which has the same feel as a waterbed, but without as much motion transfer as a conventional waterbed.

SUMMARY OF THE INVENTION

The invention, which accomplishes these objectives, comprises a comfort layer for a seating or bedding product. The comfort layer comprises an assembly or matrix of liquid pods, each liquid pod being contained within a fabric pocket. The fabric within which the liquid pods are contained may be any known fabric material. The pocket of fabric is formed between first and second plies of fabric. Each of the plies has at least one layer of fabric. One or more of the plies may be permeable or semi-impermeable to airflow or alternatively fully impermeable to airflow. Each pocket has seams joining the first and second plies of fabric. The seams may be solid or segmented, as is known in the art. The seams are typically weld seams but may be sewn seams or glued seams.

In multiple embodiments, each of the liquid pods comprises a pouch surrounding a filler such as a volume of fluid. The pouch may be made of any flexible but strong, non-permeable hydrophobic membrane. The pouch may be made from a variety of polymeric materials including, but not limited to, natural or synthetic rubber or diblock or triblock copolymer resins, potentially melted or mixed with a plasticizing agent, such as mineral oil, synthetic oil, etc. Triblock copolymers include, but are not necessarily limited to, (SB)n styrene-butadiene, (SEB)n, (SIS) styrene-isoprene-styrene block copolymers, (SEBS) styrene-ethylene-butylene-styrene block copolymers, (SEP) styrene-ethylene-propylene block copolymers, (SEEPS) styrene-ethylene-ethylene-propylene-styrene block copolymers, (SBS) styrene-butadiene-styrene block copolymers and the like. Alternatively, the pouch may be made of polyurethane elastomer or silicone. The pouches may contain additives such as colors or antimicrobial additives. The pouches of the liquid pods may be made at least partially of renewable or recycled material.

Each pouch may be at least partially filled with a liquid or a hydrogel or a solid such as a phase change material. The liquid may be water, glycerol or other gylcols or synthetic or natural oils. The liquid may contain additives such as colors or antimicrobial additives. The liquid may contain at least some water. The water may be mixed with a modifier such as a known component to lower the freezing point of the water.

In some embodiments, each of the liquid pods may further comprise a plurality of beads inside the pouch. The beads are typically hydrogel beads which constitute a group of natural or synthetic polymeric materials. The hydrophilic structure of the polymeric materials enables them to hold large amounts of water in their three-dimensional network. Natural polymers for hydrogel preparation include hyaluronic acid, chitosan, heparin, alginate and fibrin. Common synthetic polymers include polyvinyl alcohol, polyethylene glycol, sodium polyacrylate, acrylate polymers and copolymers thereof.

Alternatively, the pouches may be filled with a solid such as a wax or phase change material ("PCM") which is solid at room temperature but which turns to liquid when heat, such as when a person lays on a product containing such phase change materials. The phase change material absorbs the heat from the person, thereby changing the solid to a liquid. Phase change materials are considered latent heat storage units and can be defined as a substance with a high heat of fusion which can store and release large amounts of energy as it undergoes a phase transition, namely between the solid and liquid phases.

PCMs can be divided into the following, non-limiting classifications: Organic PCMs, which including but not limited to paraffins of the form $C_nH_{2n+2}$, and fatty acids of the form $CH_3(CH_2)_{2n}COOH$; inorganic PCMs, including, but not limited to, salt hydrates of the form $M_nH_2O$; eutectics, comprising organic-organic, organic-inorganic, and inorganic-inorganic compounds; and hygroscopic materials.

Examples of organic PCMs include, but are not limited to, water, $NaCl \cdot Na_2SO_4 \cdot 10H_2O$, sodium sulfate ($Na_2SO_4 \cdot 10H_2O$), $Na_2SiO_3 \cdot 5H_2O$, lithium, $NaNO_2$ NaCl (5.0%)/$NaNO_3$, NaOH/$Na_2CO_3$ (7.2%), NaCl/$NaNO_3$ (5.0%), NaCl (5.7%)/$NaNO_3$ (85.5%)/$Na_2SO_4$, KNO3 (10%)/$NaNO_3$, $NaNO_3$, NaOH, $KNO_3$/KCl (4.5%), lead, $KNO_3$, $KNO_3$/KBr (4.7%)/KCl (7.3%), NaCl/KCL (32.4%)/LiCl (32.8%), KOH, NaCl (26.8%)/NaOH, zinc, aluminium, silver, gold, copper, iron, titanium, $Mn(NO_3)_2 \cdot 6H_2O + MnCl_\lambda \cdot 4H_2O_{(4\%\ w/w)}$, and NaCl (42.5%)/KCl (20.5)/$MgCl_2$.

Examples of non-organic PCMs include, but are not limited to, paraffin 14-carbons, formic acid, paraffin 15-carbons, caprilic acid, paraffin 16-carbons, acetic acid, glycerin, polyethylene glycol 600, paraffin 17-carbons, p-lattic acid, paraffin 18-carbons, methyl palmitate, Trimethylolethane $(TME)_{(63\%\ w/w)}+H2O_{(37\%\ w/w)}$, paraffin 19-carbons, trimyristin, capric acid, paraffin 20-carbons, camphenilone, docasyl bromide, caprylone, paraffin 21-carbons, phenol, heptadecanone, 1-cyclohexylooctadecane, 4-heptadacanone, p-toluidine, paraffin 22-carbons, cyanamide, lauric acid, methyl eicosanoate, elaidic acid, paraffin 23-carbons, 3-heptadecanone, 2-heptadecanone, hydrocinnamic acid, cetyl acid, paraffin 25-carbons, camphene, o-nitroaniline, paraffin 24-carbons, 9-heptadecanone, thymol, methyl behenate, pentadecanoic acid, diphenyl amine, p-dichlorobenzene, oxolate, hypophosphoric acid, o-xylene dichloride, palmitic acid, β-chloroacetic acid, chloroacetic acid, tristearin, paraffin 26-carbons, nitro naphthalene, myristic acid, paraffin 27-carbons, α-naphthylamine, heptadecanoic acid, α-chloroacetic acid, paraffin 28-carbons, bee wax, bees wax, glycolic acid, glycolic acid, paraffin 29-carbons, p-bromophenol, paraffin 30-carbons, azobenzene, paraffin 31-carbons, acrylic acid, stearic acid, paraffin 32-carbons, dinitrotoluene (2,4), paraffin 33-carbons, paraffin 34-carbons, phenylacetic acid, thiosinamine, bromocamphor, benzylamine, durene, methyl bromobenzoate, acetamide, alpha naphthol, glutaric acid, p-xylene dichloride, methyl fumarate, catechol, quinone, acetanilide, succinic anhydride, benzoic acid, stilbene, and benzamide.

An alternative liquid pod may lack the beads but instead may comprise an outer pouch containing a volume of liquid such as water or glycerin or a quantity of solid such as a phase change material. The pouch of such a liquid pod may be made of the same flexible but strong, non-permeable hydrophobic membrane such as the membrane described above.

According to another aspect of the present invention, the comfort layer comprises a first piece of foam and a second piece of foam. At least one of the pieces of foam has cutouts therein. The comfort layer further comprises a plurality of liquid pods located in the cutouts. In some embodiments, each liquid pod comprises a pouch surrounding a volume of liquid. In other embodiments, each liquid pod comprises a pouch surrounding a solid such as wax or a phase change material. The pieces of foam used to contain the liquid pods may be any known foam material. The first and second pieces of foam may the same foam material or different foam materials.

According to another aspect of the present invention, the comfort layer comprises a plurality of liquid pods. Each liquid pod comprises a pouch surrounding a volume of liquid. A first ply of fabric is located on one side of the liquid pods and a second ply of fabric is located on another side of the liquid pods. The first and second plies of fabric are joined with seams around each of the liquid pods to create individual pockets which contain the liquid pods. The fabric within which the liquid pods are contained may be any known fabric material. Each of the plies has at least one layer of fabric. One or more of the plies may be semi-impermeable to airflow or fully impermeable to airflow. Each pocket has seams joining the first and second plies of fabric. The seams may be solid or segmented weld seams, as is known in the art. Alternatively, the seams may be sewn or glued seams.

Any of the embodiments of comfort layer shown or described herein may be incorporated into a bedding product, such as a mattress, bedding foundation or pillow. Further, any of the embodiments of comfort layer shown or described herein may be incorporated into a seating product, such as a vehicle seat and/or office or residential furniture, such as a recliner.

Alternatively, any of the embodiments of comfort layer shown or described herein may be sold independently as a retail or wholesale item. In such an application, the comfort layer may be added to and/or removed from a bedding or seating product by a customer.

The comfort layer of the present invention, whether incorporated inside a bedding or seating product or manufactured and sold as a separate product, provides a cooling effect to the product due to liquid pods of the comfort layer.

These and other objects and advantages of this invention will be readily apparent from the following drawings, in which:

DETAILED DESCRIPTION OF THE DRAWINGS

Figure 1:
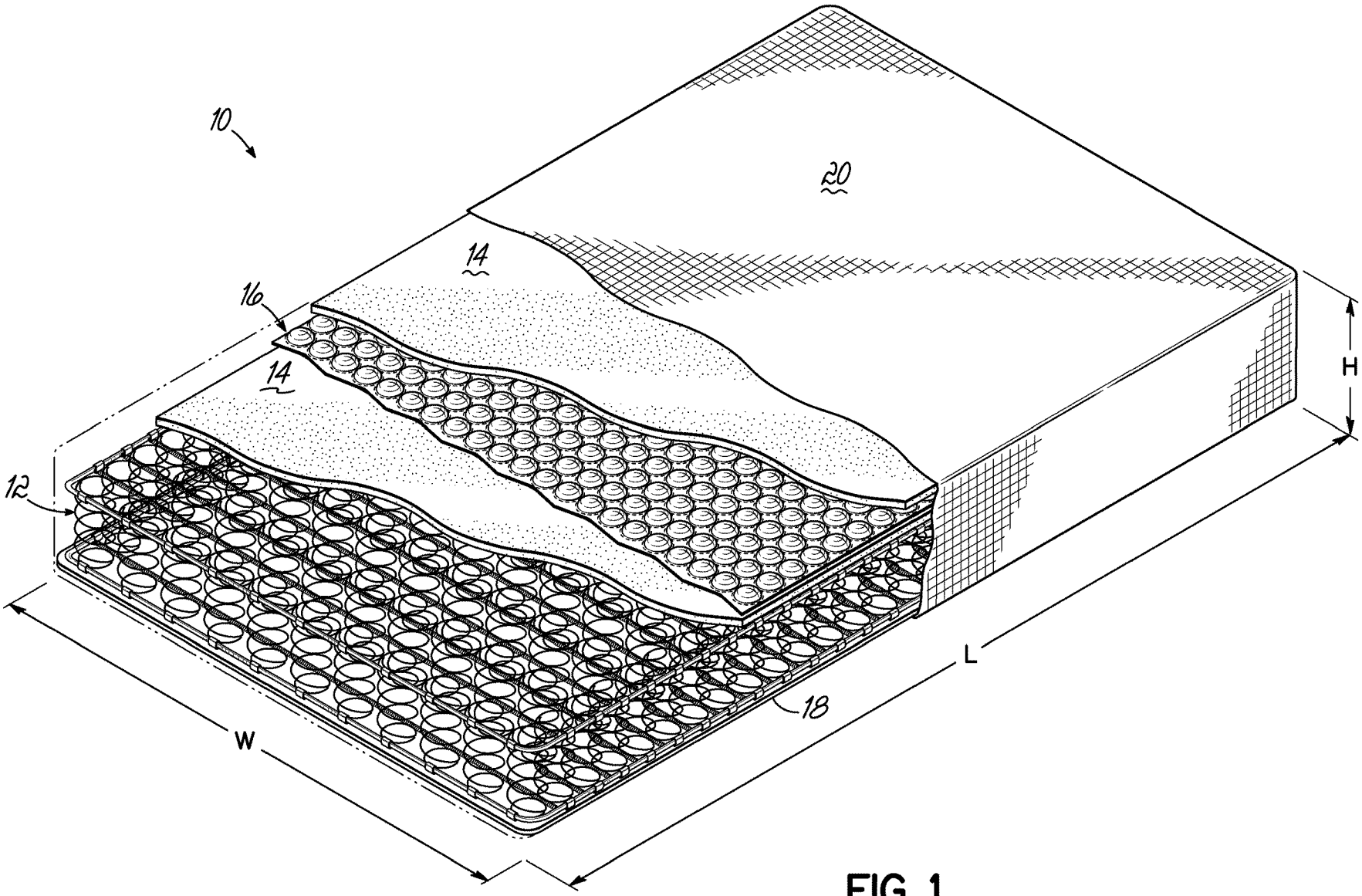
FIG. 1 is a perspective view, partially broken away, of a single-sided bedding product incorporating one of the comfort layers of this invention.

FIG. 1 illustrates a single-sided mattress 10 incorporating one embodiment of comfort layer in accordance with this invention. This mattress 10 comprises a core 12 over the top of which there is a conventional cushioning pad 14 which may be partially or entirely made of foam, fiber, gel or any combination thereof. The cushioning pad 14 may be covered by a comfort layer 16 constructed in accordance with the present invention. A second conventional cushioning pad 14 may be located above the comfort layer 16. In some applications, one or more of the cushioning pads 14 may be omitted. In other applications, one or more comfort layers containing mini coil springs, such as the comfort layers disclosed in U.S. Pat. Nos. 9,943,173; 9,968,202; 10,405,665; 10,667,615 and 10,813,462 may be located above or below the core 12. This complete assembly may be mounted upon a base 18 and is completely enclosed within a cover 20, such as an upholstered cover for example.

As shown in FIG. 1, mattress 10 has a longitudinal dimension or length L, a transverse dimension or width W and a height H. Although the length L is shown as being greater than the width W, they may be identical. The length, width and height may be any desired distance and are not intended to be limited by the drawings.

While several embodiments of comfort layer are illustrated and described as being used in a single-sided mattress, any of the comfort layers shown or described herein may be used in a single-sided mattress, double-sided mattress or seating cushion.

Figure 1A:
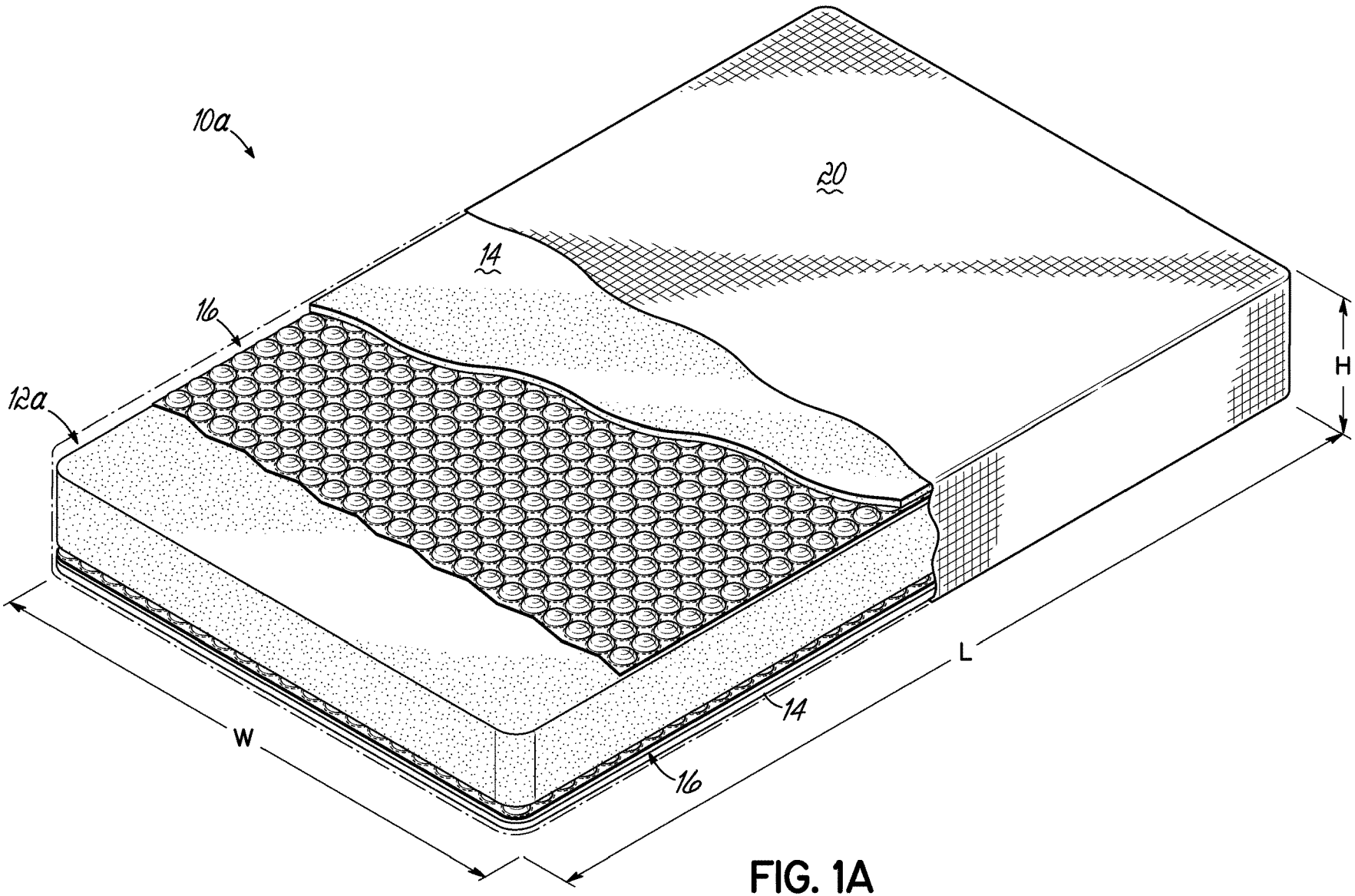
FIG. 1A is a perspective view, partially broken away, of a double-sided bedding product incorporating one of the comfort layers of this invention.

FIG. 1A shows a double-sided mattress 10*a* having a foam core 12*a*, comfort layers 16 above and below the foam core 12*a* and cushion layers 14 above and below the comfort layers 16. In the event that any such comfort layer is utilized in connection with a double-sided product, the bottom side of the product's core may have a comfort layer applied over the bottom side of the core and either comfort layer may be covered by one or more cushioning pads made of any conventional material. According to the practice of this invention, though, either the cushioning pad or pads, on top and/or bottom of the core, may be omitted. The novel features of the present invention reside in the comfort layer.

Although core 12 illustrated in FIG. 1 being made of unpocketed coil springs held together with helical lacing wires, the core of any bedding or seating product, such as mattresses shown or described herein, may be made wholly or partially of pocketed coil springs (see FIG. 5), one or more foam pieces (see FIG. 1A) or any combination thereof. Any of the comfort layers described or shown herein may be used in any single or double-sided bedding or seating product having any conventional core. The core may be any conventional core including, but not limited to, pocketed or conventional spring cores. The core is not intended to limit the present invention.

Figure 2:
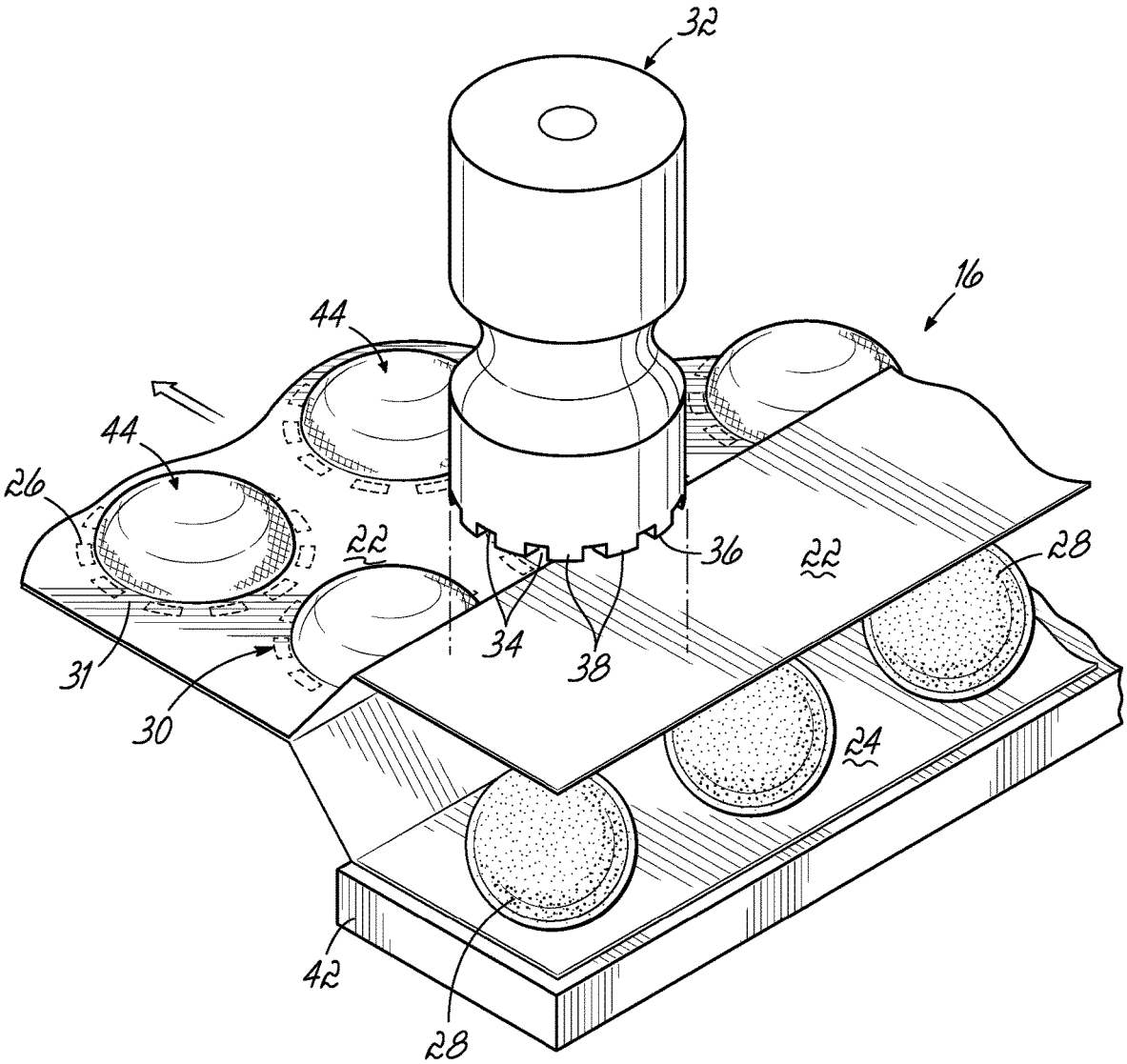
FIG. 2 is an enlarged perspective view of a portion of the comfort layer of FIG. 1 partially disassembled and showing a portion of a welding tool.

FIG. 2 illustrates the components of one embodiment of comfort layer 16 incorporated into the mattress 10 shown in FIG. 1. The comfort layer 16 comprises a first or upper ply of fabric 22 and a second or lower ply of fabric 24 with a plurality of liquid pods 28 therebetween. The fabric plies 22, 24 are joined with circular containments or weld seams 30, each weld seam 30 surrounding a liquid pod 28. Each circular weld seam 30 comprises multiple arced or curved weld segments 26 with gaps 31 therebetween. The first and second plies of fabric 22, 24 are joined along each arced or curved weld segment 26 of each circular weld seam 30. The first and second plies of fabric 22, 24 are not joined along each gap 31 between adjacent weld segments 26 of each circular weld seam 30. The curved weld segments 26 are strategically placed around a liquid pod 28 and create the circular weld seam 30. The two plies of fabric 22, 24, in combination with one of the the circular weld seams 30, define a cylindrical-shaped pocket 44, inside of which is at least one liquid pod 28. See FIGS. 3 and 3A.

Figure 3:
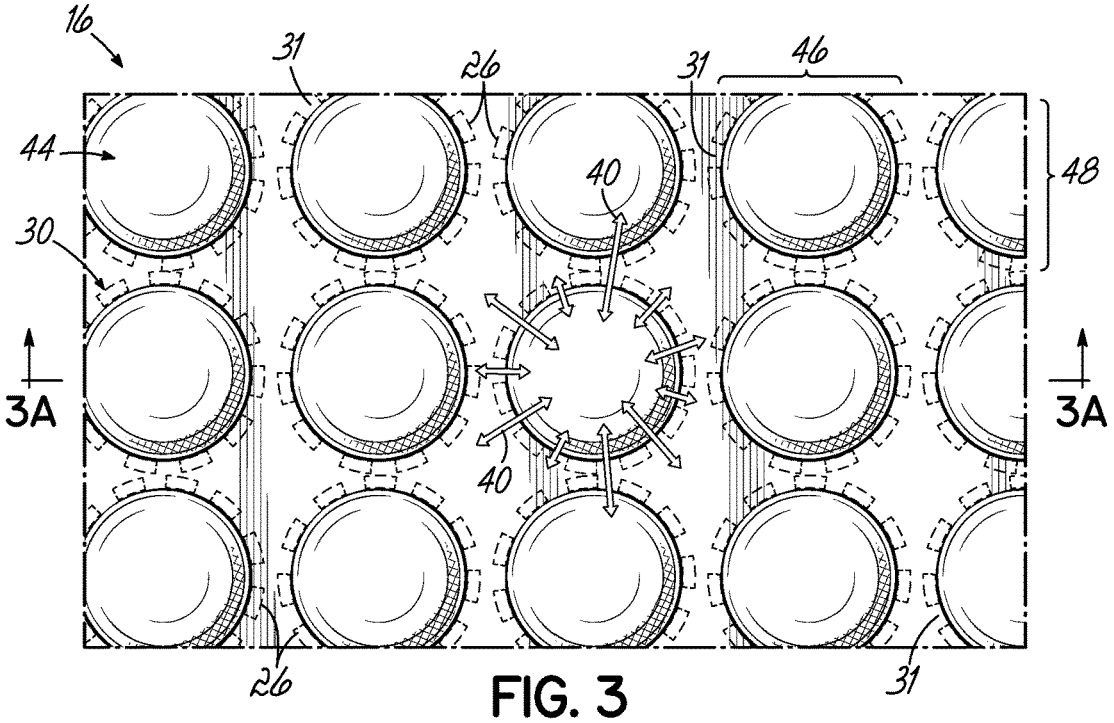
FIG. 3 is a top plan view of a portion of the comfort layer of FIG. 1, the arrows showing airflow inside the comfort layer.
Figure 3A:
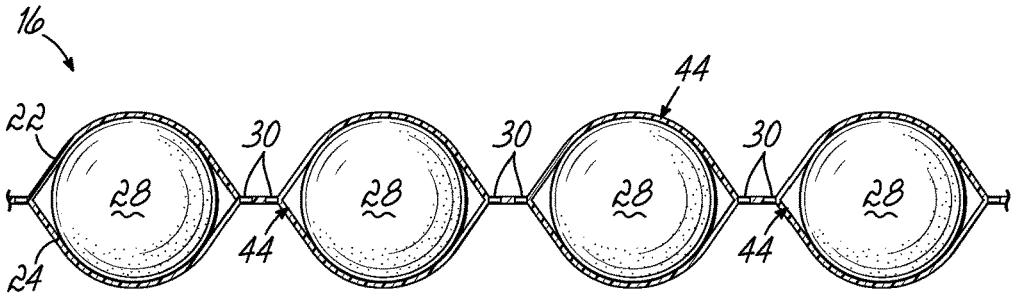
FIG. 3A is a cross-sectional view taken along the line 3A-3A of FIG. 3.
Figure 3B:
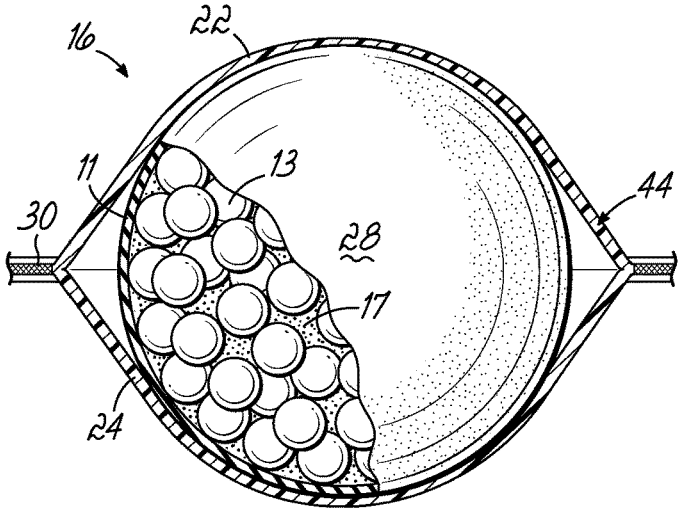
FIG. 3B is an enlarged cross-sectional view, partially broken away, of one of the pockets of the comfort layer of FIG. 3A containing a liquid pod.
Figure 3C:
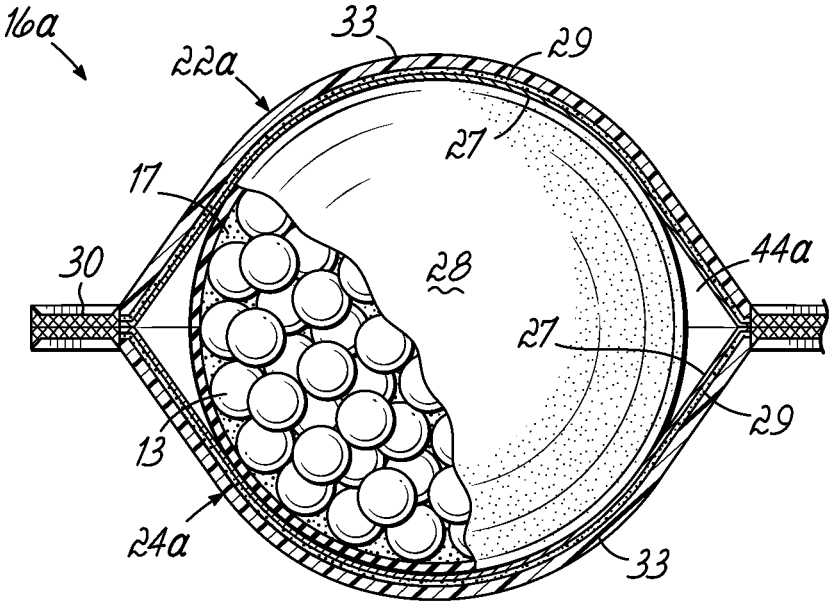
FIG. 3C is an enlarged cross-sectional view, partially broken away, of a pocket of an alternative embodiment of comfort layer having a different fabric.

As shown in FIGS. 3B and 3C, the liquid pod 28 comprises an outer pouch 11 surrounding a plurality of beads 13. FIG. 3B illustrates the liquid pod 28 surrounded by single layer fabric while FIG. 3C shows the same liquid pod 28 surrounded by different fabric. Although the beads 13 are illustrated all being the same size, they may be different sizes within the liquid pod 28. The outer pouch 11 does not to be filled with beads 13; any desired quantity of beads 13 may be located inside the outer pouch 11 of the liquid pod 28. The drawings are not intended to be limiting.

The outer pouch 11 may be made of any flexible but strong, non-permeable hydrophobic membrane. The pouch 11 may be made from a variety of polymeric materials including, but not limited to, natural or synthetic rubber or deblock or triblock copolymer resins, potentially melted or mixed with a plasticizing agent, such as mineral oil, synthetic oil, etc. The polymeric materials of pouch 11 may be made from any type of plastic such as vinyl, polyurethane, polyurea or silicone. Each of the beads 13 moves inside the outer pouch 11 as does a filler 17. The filler 17 may comprise a volume of liquid such as water or glycerin or a volume of hydrogel or a quantity of solid material such as a phase change material as described above or wax.

Figure 3D:
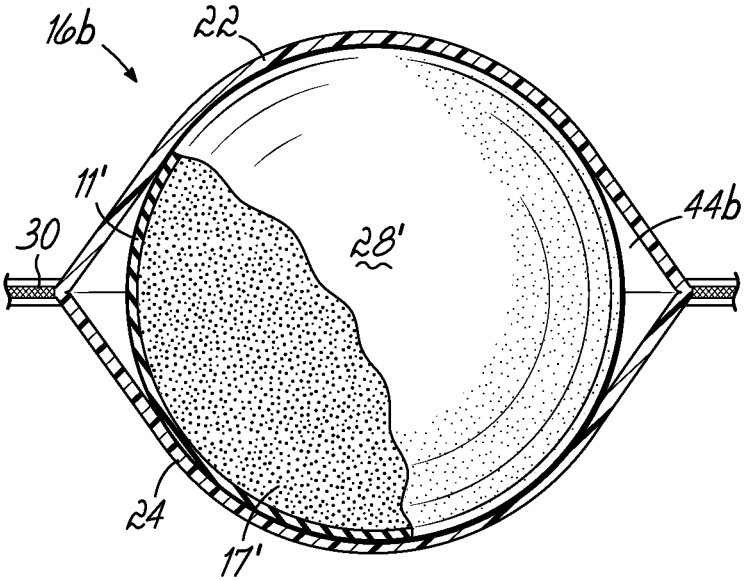
FIG. 3D is an enlarged cross-sectional view, partially broken away, of a pocket of an alternative embodiment of comfort layer having a different liquid pod than the liquid pod of FIGS. 3B and 3C.

As shown in FIG. 3D, another embodiment of liquid pod 28' may be incorporated into any comfort layer shown or described herein. Liquid pod 28' comprises an outer pouch 11' surrounding a filler 17'. The liquid pod 28' contains no beads. The outer pouch 11' may be made of natural or synthetic rubber or any type of plastic such as vinyl, polyurethane, polyurea or silicone. The filler 17' contained inside the outer pouch 11' may be a volume of liquid such as water or glycerin or a volume of hydrogel or a quantity of solid material such as a wax or phase change material as described above.

In any of the embodiments shown or described herein, the liquid pods 28, 28' may be any desired size. Although the liquid pods are illustrated all being the same size, they may be different sizes within a comfort layer. The drawings are not intended to be limiting.

Figure 4:
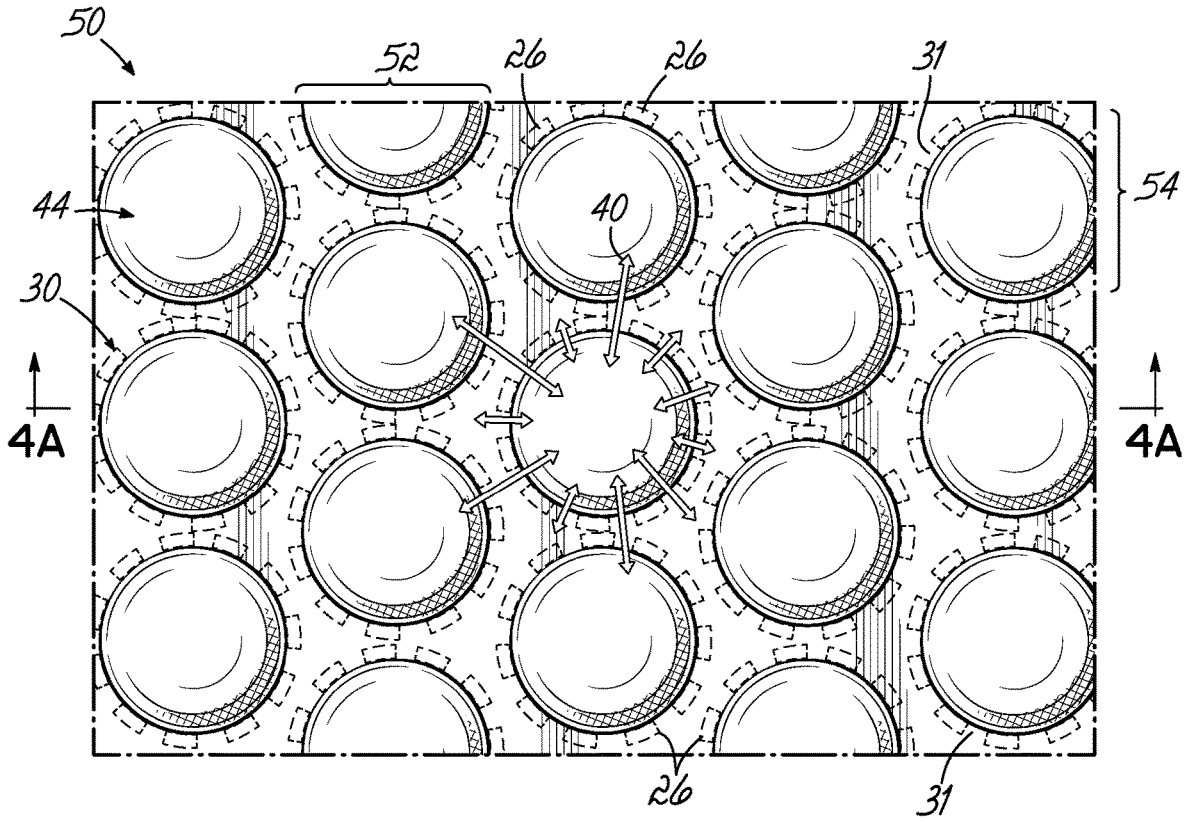
FIG. 4 is a top plan view of a portion of another comfort layer, the arrows showing airflow inside the comfort layer.
Figure 4A:
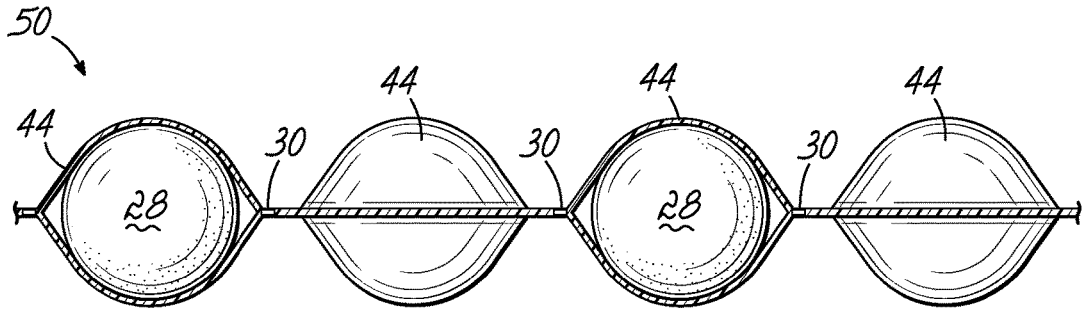
FIG. 4A is a cross-sectional view taken along the line 4A-4A of FIG. 4.

The size of the curved weld segments 26 of weld seams 30 is not intended to be limited by the illustrations; they may be any desired size depending upon the airflow desired inside the comfort layer. Similarly, the size, i.e., diameter of the illustrated weld seams 30, is not intended to be limiting. The placement of the weld seams 30 shown in the drawings is not intended to be limiting either. For example, the weld seams 30 may be organized into aligned rows and columns, as shown in FIGS. 3 and 3A or organized with adjacent columns being offset from each other, as illustrated in FIGS. 4 and 4A. Any desired arrangement of weld seams may be incorporated into any embodiment shown or described herein.

The weld segments may assume shapes other than the curved weld segments illustrated. For example, the weld seams may be circular around liquid pods, but the weld segments may assume other shapes, such as triangles or circles or ovals of the desired size and pattern to obtain the desired airflow between adjacent pockets inside the comfort layer and into or out of the perimeter of the comfort layer.

With reference to FIG. 2, there is illustrated a portion of a mobile ultrasonic welding horn 32 and anvil 42. The movable ultrasonic welding horn 32 has a plurality of spaced cut-outs or slots 34 along its lower edge 36. The remaining portions 38 of the ultrasonic welding horn's bottom 36 between the slots 34 are the portions which weld the two plies of fabric 22, 24 together and create the curved weld segments 26. Along the ultrasonic welding horn's bottom edge 36, the ultrasonic welding horn 32 can be milled to make the slots a desired length to allow a desired airflow between the curved weld segments 26 as illustrated by the arrows 40 of FIG. 3. The airflows affect the feel/compression of the liquid pods 28 when a user lays on the mattress 10.

As shown in FIG. 2, underneath the second ply of fabric 24 is an anvil 42 comprising a steel plate of $\frac{3}{8}^{th}$ inch thickness. However, the anvil may be any desired thickness. During the manufacturing process, the ultrasonic welding horn 32 contacts the anvil 42, the two plies of fabric 22, 24 therebetween, to create the circular weld seams 30 and hence, cylindrical-shaped pockets 44, at least one liquid pod 28 being in each pocket 44.

These curved weld segments 26 are created by the welding horn 32 of a machine (not shown) having multiple spaced protrusions 38 on the ultrasonic welding horn 32. As a result of these circular weld seams 30 joining plies of fabric 22, 24, the plies 22, 24 define a plurality of spring-containing pockets 44 of the comfort layer 16. One or more liquid pods 28 may be contained within an individual pocket 44.

Figure 2A:
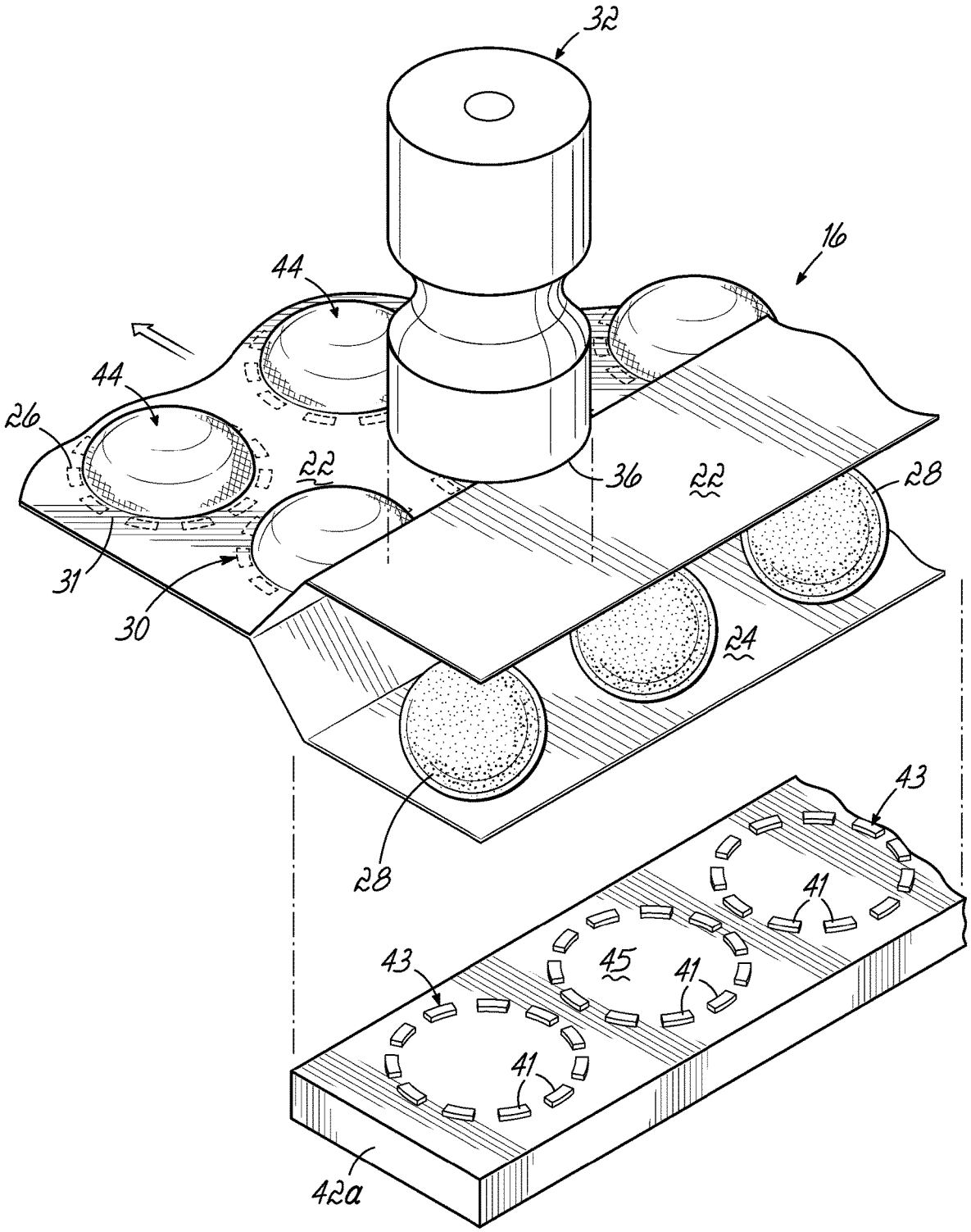
FIG. 2A is an enlarged perspective view of a portion of the comfort layer of FIG. 1 partially disassembled and showing a portion of another welding tool.

FIG. 2A illustrates another apparatus for forming the circular weld seams 30 comprising multiple curved weld segments 26 having gaps 31 therebetween for airflow. In this apparatus, the ultrasonic welding horn 32*a* has no protrusions on its bottom surface 39. Instead, the bottom surface 39 of ultrasonic welding horn 32*a* is smooth. As shown in FIG. 2A, the anvil 42*a* has a plurality of curved projections 41, which together form a projection circle 43. A plurality of projection circles 43 extend upwardly from the generally planar upper surface 45 of anvil 42*a*. When the ultrasonic welding horn 32*a* moves downwardly and sandwiches the plies 22, 24 of fabric between one of the projection circles 43 and the smooth bottom surface 39 of ultrasonic welding horn 32*a*, a circular weld seam 30 is created, as described above. Thus, a plurality of pockets 44 are created by the circular weld seams 30, each pocket 44 containing at least one liquid pod 28.

In the embodiments in which the fabric material of plies 22, 24 defining pockets 44 and enclosing the liquid pods 28 therein is non-permeable or impermeable to airflow, upon being subjected to a load, a pocket 44 containing at least one liquid pod 28 is moved by exerting pressure to the liquid pod(s) 28 and air contained within the pocket 44. Air exits the pocket 44 through gaps 31 between the curved weld segments 26 of the circular weld seams 30. Similarly, when a load is removed from the pocket 44, the liquid pod 28 separates the fabric layers 22, 24, and air re-enters the pocket 44 through the gaps 31 between the curved weld segments 26 of the circular weld seams 30. As shown in FIG. 3, the size of the gaps 31 between the curved weld segments 26 of circular seams 30 of perimeter pockets 44 defines how quickly air may enter or exit the comfort layer 16.

As best illustrated in FIG. 3, the individual pockets 44 of comfort layer 16 may be arranged in longitudinally extending columns 46 extending from head-to-foot of the bedding product and transversely extending rows 48 extending from side-to-side of the bedding product. As shown in FIGS. 3 and 3A, the individual pockets 44 of one column 46 are aligned with the pockets 44 of adjacent columns 46.

FIG. 3C illustrates a portion of an alternative embodiment of comfort layer 16*a*. Comfort layer 16*a* comprises a first or upper ply of fabric 22*a* and a second or lower ply of fabric 24*a* with a plurality of liquid pods 28 therebetween. The fabric plies 22*a*, 24*a* are joined with circular containments or weld seams 30, each weld seam 30 surrounding a liquid pod 28 and creating a pocket 44*a*. In this embodiment, the fabric material of each of the first and second plies 22*a*, 24*a* may be a three-layered fabric impermeable to airflow. Each ply of fabric 22*a*, 24*a* comprises three layers, including from the inside moving outwardly: 1) a protective layer of fabric 27; 2) an airtight layer 29; and 3) an outer layer 33. Such fabric is described in detail in U.S. Pat. No. 9,968,202, which is fully incorporated by reference herein.

FIG. 3D illustrates a portion of an alternative embodiment of comfort layer 16*b*. Comfort layer 16*b* comprises a first or upper ply of fabric 22 and a second or lower ply of fabric 24 with a plurality of liquid pods 28' therebetween. The fabric plies 22, 24 are joined with circular containments or weld seams 30, each weld seam 30 surrounding a liquid pod 28' and creating a pocket 44*b*. In this embodiment, the fabric material of each of the first and second plies 22, 24 is a single-layered fabric permeable to airflow. Each liquid pod 28' is as described above.

FIGS. 4 and 4A illustrate another comfort layer 50 having the same pockets 44 and same liquid pods 28 as does comfort layer 16 of FIGS. 1-3A. As best illustrated in FIG. 4, the individual pockets 44 of comfort layer 50 are arranged in longitudinally extending columns 52 extending from head-to-foot of the bedding product and transversely extending rows 54 extending from side-to-side of the bedding product. As shown in FIGS. 4 and 4A, the individual pockets 44 of one column 52 are offset from, rather than aligned with, the pockets 44 of the adjacent columns 52. Similarly, the individual pockets 44 of one row 54 are offset from, rather than aligned with, the pockets 44 of the adjacent rows 54.

Figure 5:
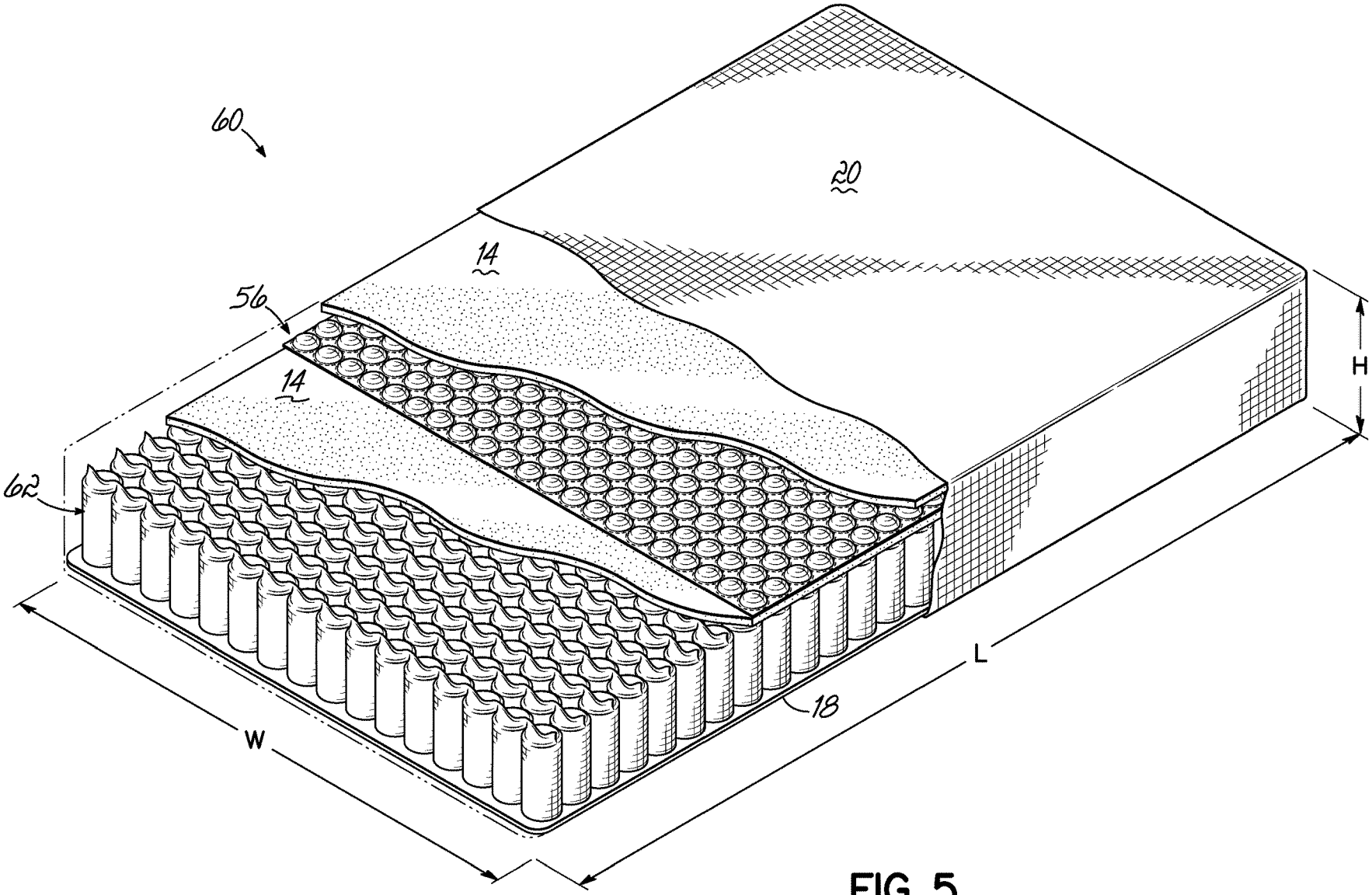
FIG. 5 is a perspective view, partially broken away, of a bedding product incorporating another embodiment of comfort layer in accordance with the present invention.

FIG. 5 illustrates an alternative embodiment of comfort layer 56 incorporated into a single-sided mattress 60. Single-sided mattress 60 comprises a pocketed spring core 62, a cushioning pad 14 on top of the pocketed spring core 62, a base 18, another cushioning pad 14 above comfort layer 56, and a cover 20, such as an upholstered covering. Pocketed spring core 62 may be incorporated into any bedding or seating product, including a double-sided mattress, and is not intended to be limited to single-sided mattresses. As described above, comfort layer 56 may be used in any bedding or seating product, including a spring core made with non-pocketed coil springs or one or more pieces of foam.

As shown in FIG. 5, mattress 60 has a longitudinal dimension or length L, a transverse dimension or width W and a height H. Although the length L is shown as being greater than the width W, they may be identical. The length, width and height may be any desired distance and are not intended to be limited by the drawings.

Figure 6:
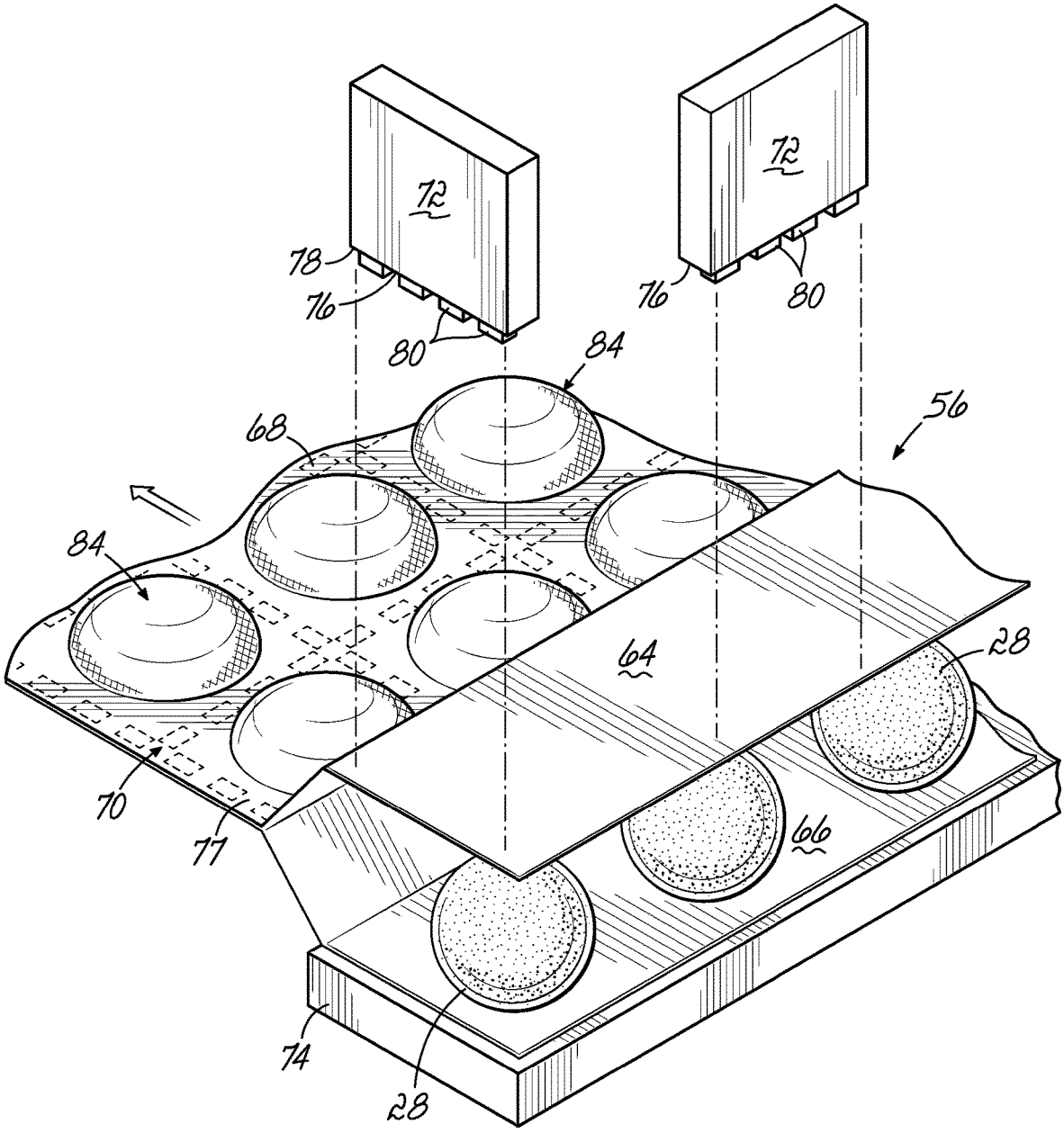
FIG. 6 is an enlarged perspective view of a portion of the comfort layer of FIG. 5 partially disassembled and showing a portion of a welding tool.

FIG. 6 illustrates the components of the comfort layer 56 incorporated into the mattress 60 shown in FIG. 5. The comfort layer 56 comprises a first ply of fabric 64 and a second ply of fabric 66 joined with linear or straight weld seams 70, each weld seam 70 comprising multiple linear weld segments 68. These weld seams 70 are strategically placed around a liquid pod 28 and create a rectangular containment or pocket 84 made from intersecting weld seams 70. The length and/or width of the linear weld segments 68 of weld seams 70 is not intended to be limited to those illustrated; the weld segments may be any desired size depending upon the airflow desired through the comfort layer.

Similarly, the shape, as well as the size, of the weld seams of any of the weld seams shown or described herein is not intended to be limiting. Shapes other than linear weld segments 68 may be used to create weld seams 70, as well as any weld seams shown or described herein. For purposes of this document, "weld segment" is not intended to be limited to linear segments. A "weld segment" of a weld seam is intended to include such shapes as triangles or circles or ovals of any desired size and pattern to obtain the desired airflow between adjacent pockets and into or out of the perimeter of the comfort layer.

With reference to FIG. 6, there is illustrated a portion of an ultrasonic welding horn 72 and anvil 74. The mobile or movable ultrasonic welding horn 72 has a plurality of spaced cut-outs or slots 76 between projections 80. The projections 80 of the ultrasonic welding horn 72 are the portions which weld the two plies of fabric 64, 66 together and create the linear weld segments 68 along weld seams 70. Along the ultrasonic welding horn's lower portion 78, the ultrasonic welding horn 72 can be milled to allow a desired airflow between the linear weld segments 68 as illustrated by the arrows 82 of FIG. 7. The airflows affect the feel of the individually pocketed liquid pods 28 when a user lays on the mattress 60.

As shown in FIG. 6, underneath the second ply 66 is an anvil 74 comprising a steel plate of ⅜$^{th}$ inch thickness. However, the anvil may be any desired thickness. During the manufacturing process, the ultrasonic welding horn 72 contacts the anvil 74, the two plies of fabric 64, 66 being therebetween, to create the intersecting linear weld seams 70 and, hence, pockets 84, at least one liquid pod 28 being in each pocket 84. See FIGS. 7 and 7A.

These linear weld segments 68 may be created by the welding horn 72 of a machine (not shown) having multiple spaced protrusions 80 on the ultrasonic welding horn 72. As a result of these linear or straight intersecting weld seams 70 defining the liquid pod-containing pockets 84 of the comfort layer 56, each liquid pod 28 is contained within its own individual pocket 84. Air exits the pocket 84 through gaps 77 between the weld segments 68 of the intersecting weld seams 70. Similarly, when a load is removed from the pocket 84, the liquid pod 28 separates the fabric layers 64, 66, and air re-enters the pocket 84 though the gaps 77 between the weld segments 68 of the intersecting weld seams 70. As shown in FIG. 10, the size of the gaps 77 between the segments 68 of intersecting weld seams 70 of the pockets 84 defines how quickly air may enter or exit the pockets 84 of the comfort layer 56.

Figure 6A:
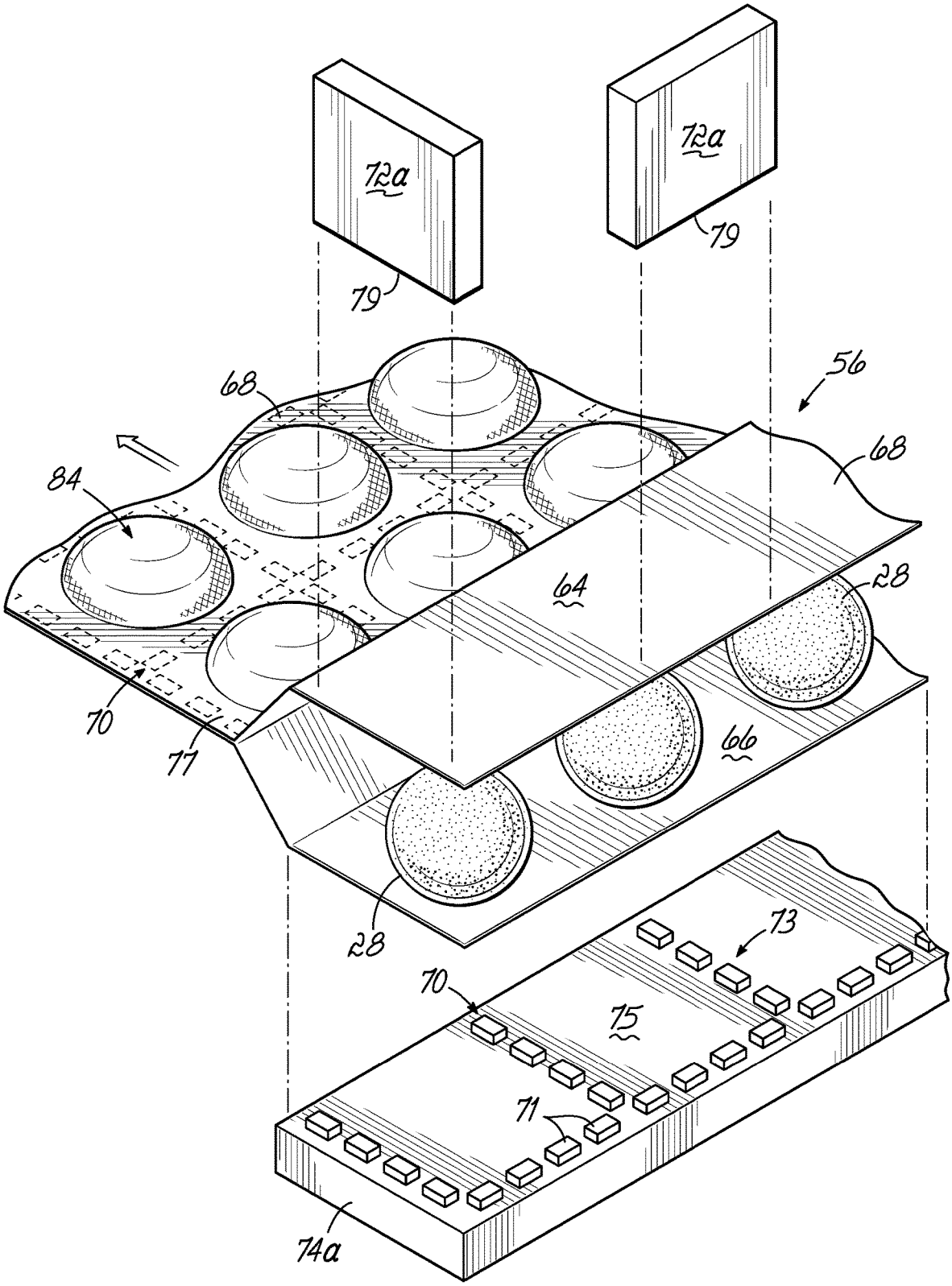
FIG. 6A is an enlarged perspective view of a portion of the comfort layer of FIG. 5 partially disassembled and showing a portion of another welding tool.

FIG. 6A illustrates another apparatus for forming the linear weld seams 70, each weld seam 70 comprising multiple linear weld segments 68 having gaps 77 therebetween for airflow. In this apparatus, the ultrasonic welding horn 72*a* has no protrusions on its bottom surface 79. Instead, the bottom surface 79 of ultrasonic welding horn 72*a* is smooth. The anvil 74*a* has a plurality of linear projections 71, which together form a projection pattern 73, shown in FIG. 6A. A plurality of spaced projections 71 in pattern 73 extend upwardly from the generally planar upper surface 75 of anvil 74*a*. When the ultrasonic welding horn 72*a* moves downwardly and sandwiches the plies 64, 66 of fabric between the projections 71 and the smooth bottom surface 79 of ultrasonic welding horn 72*a*, intersecting weld seams 70 are created. Thus, a plurality of pockets 84 are created by the intersecting weld seams 70, each pocket 84 containing at least one liquid pod 28.

Alternatively, the fabric material of the first and second plies of any of the embodiments shown or disclosed herein may be material disclosed in U.S. Pat. Nos. 7,636,972; 8,136,187; 8,474,078; 8,484,487 and 8,464,381, each one of which is fully incorporated herein. Similarly, the weld seams disclosed in any one of U.S. Pat. Nos. 7,636,972; 8,136,187; 8,474,078; 8,484,487 and 8,464,381 may be used in a comfort layer having liquid pods as disclosed herein.

Figure 7:
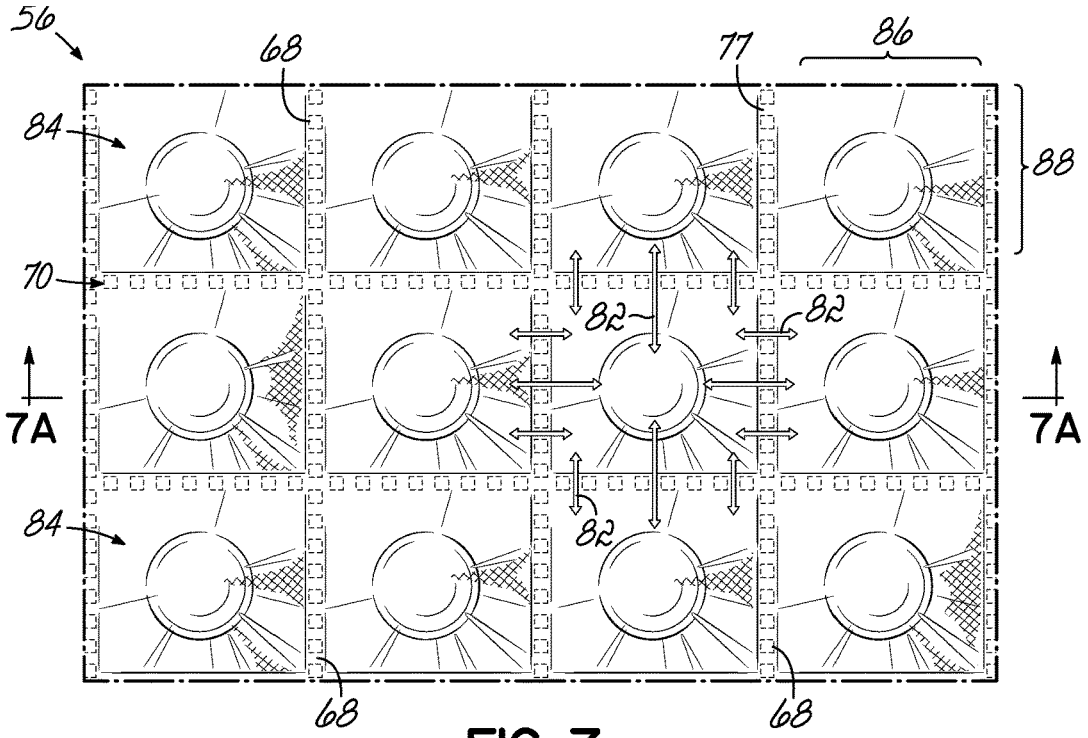
FIG. 7 is a top plan view of a portion of the comfort layer of FIG. 5, the arrows showing airflow inside the comfort layer.
Figure 7A:
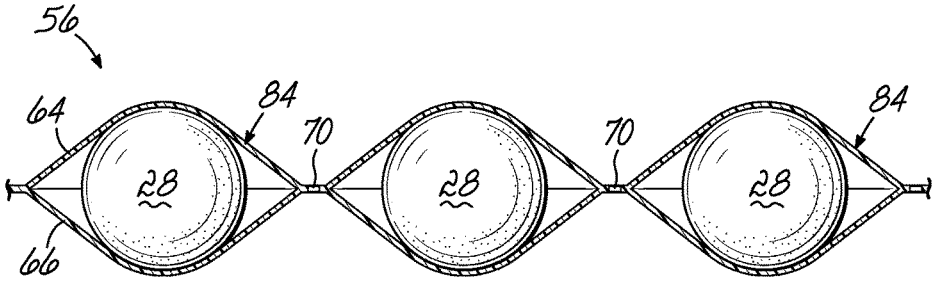
FIG. 7A is a cross-sectional view taken along the line 7A-7A of FIG. 7.
Figure 7B:
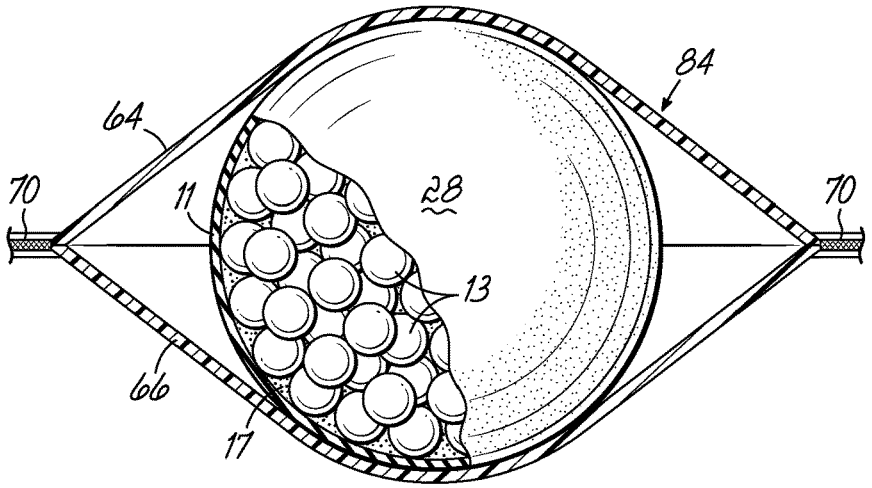
FIG. 7B is an enlarged cross-sectional view, partially broken away, of one of the pockets of the comfort layer of FIG. 7A containing a liquid pod.

As best illustrated in FIG. 7, the individual pockets 84 of comfort layer 56 may be arranged in longitudinally extending columns 86 extending from head-to-foot of the bedding product and transversely extending rows 88 extending from side-to-side of the bedding product. As shown in FIGS. 7 and 7A, the individual pockets 84 of one column 86 are aligned with the pockets 84 of the adjacent columns 86. Air may flow between pockets 84 and into and out of the comfort layer 56 between the linear segments 68 of weld seams 70.

Figure 7C:
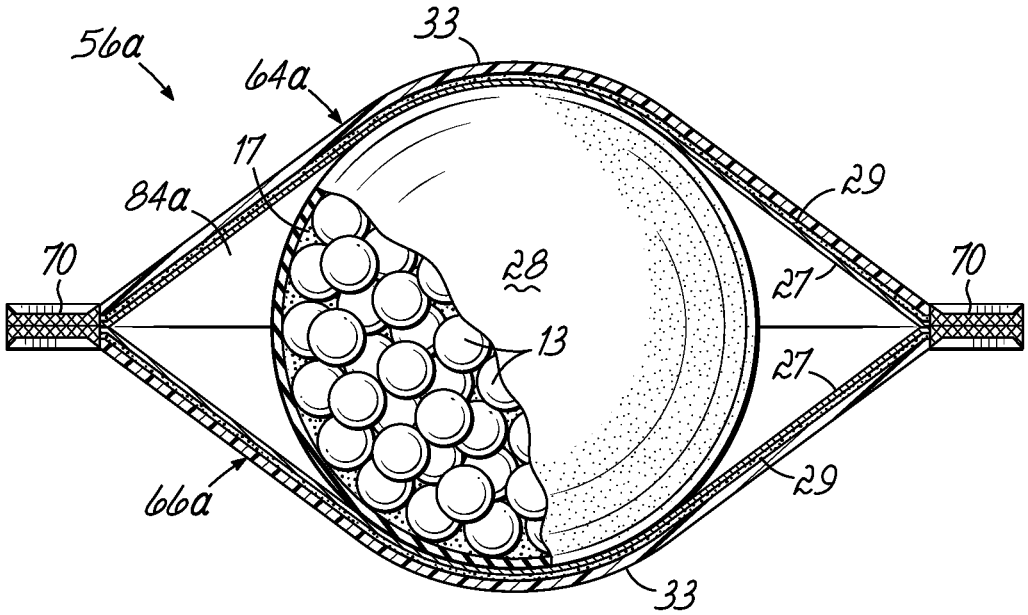
FIG. 7C is an enlarged cross-sectional view, partially broken away, of an alternative embodiment of comfort layer having a different fabric but the same liquid pod as FIG. 7B.

FIG. 7C illustrates a portion of an alternative embodiment of comfort layer 56*a*. Comfort layer 56*a* comprises a first or upper ply of fabric 64*a* and a second or lower ply of fabric 66*a* with a plurality of liquid pods 28 therebetween. The fabric plies 64*a*, 66*a* are joined with intersecting linear weld seams 70, each weld seam 70 surrounding a liquid pod 28 and creating a pocket 84*a*. In this embodiment, the fabric material of each of the first and second plies 64*a*, 66*a* may be a three-layered fabric impermeable to airflow. Each ply of fabric 64*a*, 66*a* comprises three layers, including from the inside moving outwardly: 1) a protective layer of fabric 27; 2) an airtight layer 29; and 3) an outer layer 33. Such fabric is described in detail in U.S. Pat. No. 9,968,202, which is fully incorporated by reference herein.

Figure 7D:
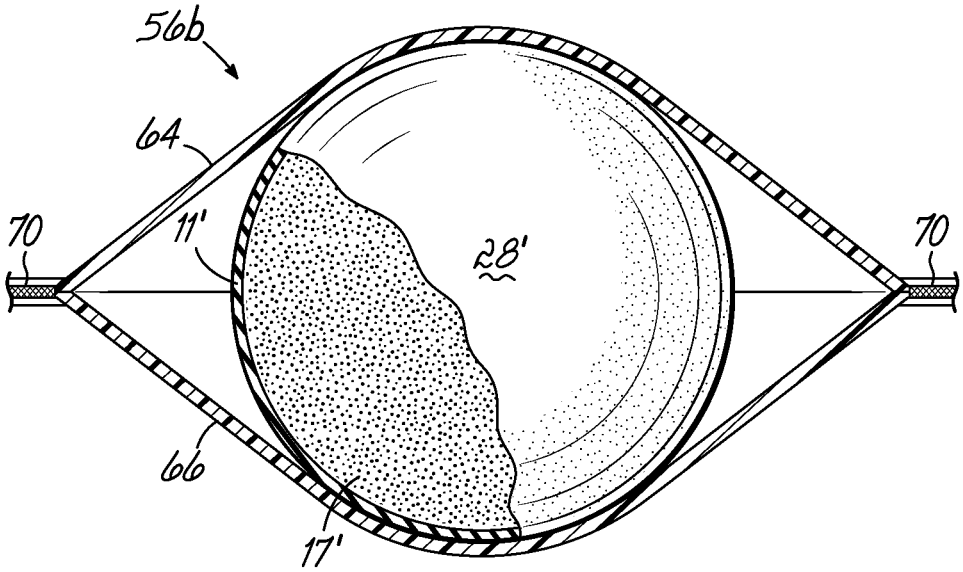
FIG. 7D is an enlarged cross-sectional view, partially broken away, of a pocket of an alternative embodiment of comfort layer having a different liquid pod than the liquid pod of FIGS. 7B and 7C.

FIG. 7D illustrates a portion of an alternative embodiment of comfort layer 56*b*. Comfort layer 56*b* comprises a first or upper ply of fabric 64 and a second or lower ply of fabric 66 with a plurality of liquid pods 28' therebetween. The fabric plies 64, 66 are joined with intersecting linear containments or weld seams 70, each weld seam 70 surrounding a liquid pod 28' and creating a pocket 84*b*. In this embodiment, the fabric material of each of the first and second plies 64, 66 is a single-layered fabric permeable to airflow. Each liquid pod 28' is as described above.

Figure 8A:
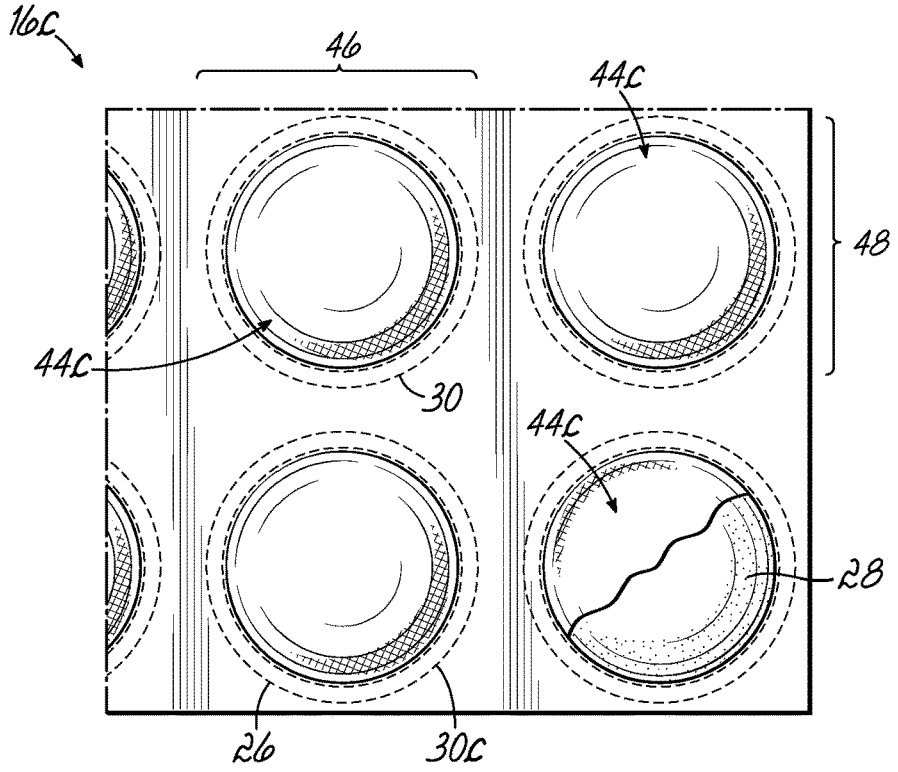
FIG. 8A is a top plan view of a corner portion of another embodiment of comfort layer.

FIG. 8A illustrates one corner of an alternative embodiment of comfort layer 16*c*, which may be used in any bedding or seating product. The comfort layer 16*c* comprises aligned rows 48 and columns 46 of pockets 44*c*, each pocket 44*c* comprising a circular weld seam 30*c* joining upper and lower plies of fabric, as described above. However, each of the circular weld seams 30*c* is a continuous seam, as opposed to a seam having curved weld segments with gaps therebetween to allow airflow through the circular seam. These circular weld seams 30*c* of pockets 44*c* allow no airflow through the circular weld seams 30*c*. Therefore, the fabric material of the first and second plies of pockets 44*c* of comfort layer 16*c* must be made of permeable or semi-impermeable fabric to manage or control airflow into and out of the pockets 44*c* of comfort layer 16*c*. The type of material used for comfort layer 16*c* solely controls the amount of air entering the comfort layer 16*c* when a user gets off the bedding or seating product, thus allowing the liquid pods 28 in the pockets 44*c* to expand and air to flow into the comfort layer 16*c*. Similarly, when a user gets onto a bedding or seating product, the liquid pods 28 compress and cause air to exit the pockets 44*c* of the comfort layer 16*c* and exit the comfort layer. The amount of air exiting the comfort layer 16*c* affects the feel/compression of the individually pocketed liquid pods 28 when a user lays on the product incorporating the comfort layer 16*c*.

Figure 8B:
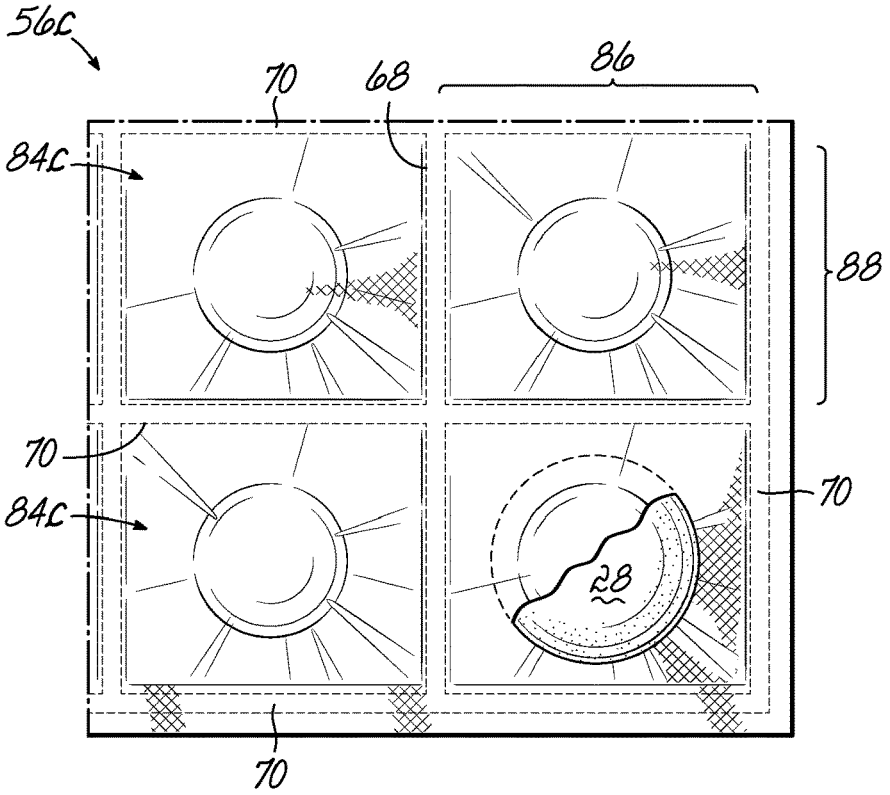
FIG. 8B is a top plan view of a corner portion of another embodiment of comfort layer.

FIG. 8B illustrates one corner of an alternative embodiment of comfort layer 56*c*, which may be used in any bedding or seating product. The comfort layer 56*c* comprises aligned rows 88 and columns 86 of pockets 84*c*, each pocket 84*c* comprising intersecting weld seams 70*c* joining upper and lower plies of fabric as described above. However, each of the intersecting weld seams 70*c* is a continuous seam, as opposed to a seam having weld segments with gaps therebetween to allow airflow through the seam. These intersecting weld seams 70*c* of pockets 84*c* allow no airflow through the weld seams 70*c*. Therefore, the fabric material of the first and second plies of pockets 84*c* of comfort layer 56*c* must be made of permeable or semi-impermeable fabric to allow some airflow into and out of the pockets 84*c* of comfort layer 56*c*. The type of material used for comfort layer 56*c* solely controls the amount of air entering the comfort layer 56*c* when a user gets off the bedding or seating product, thus allowing the liquid pods 28 in the pockets 84*c* to expand and air to flow into the comfort layer 56*c*. Similarly, when a user gets onto a bedding or seating product, the liquid pods 28 compress and cause air to exit the pockets 84*c* of the comfort layer 56*c* and exit the comfort layer. The amount of air exiting the comfort layer 56*c* affects the feel/compression of the individually pocketed liquid pods 28 when a user lays on the product incorporating the comfort layer 56*c*.

Figure 9A:
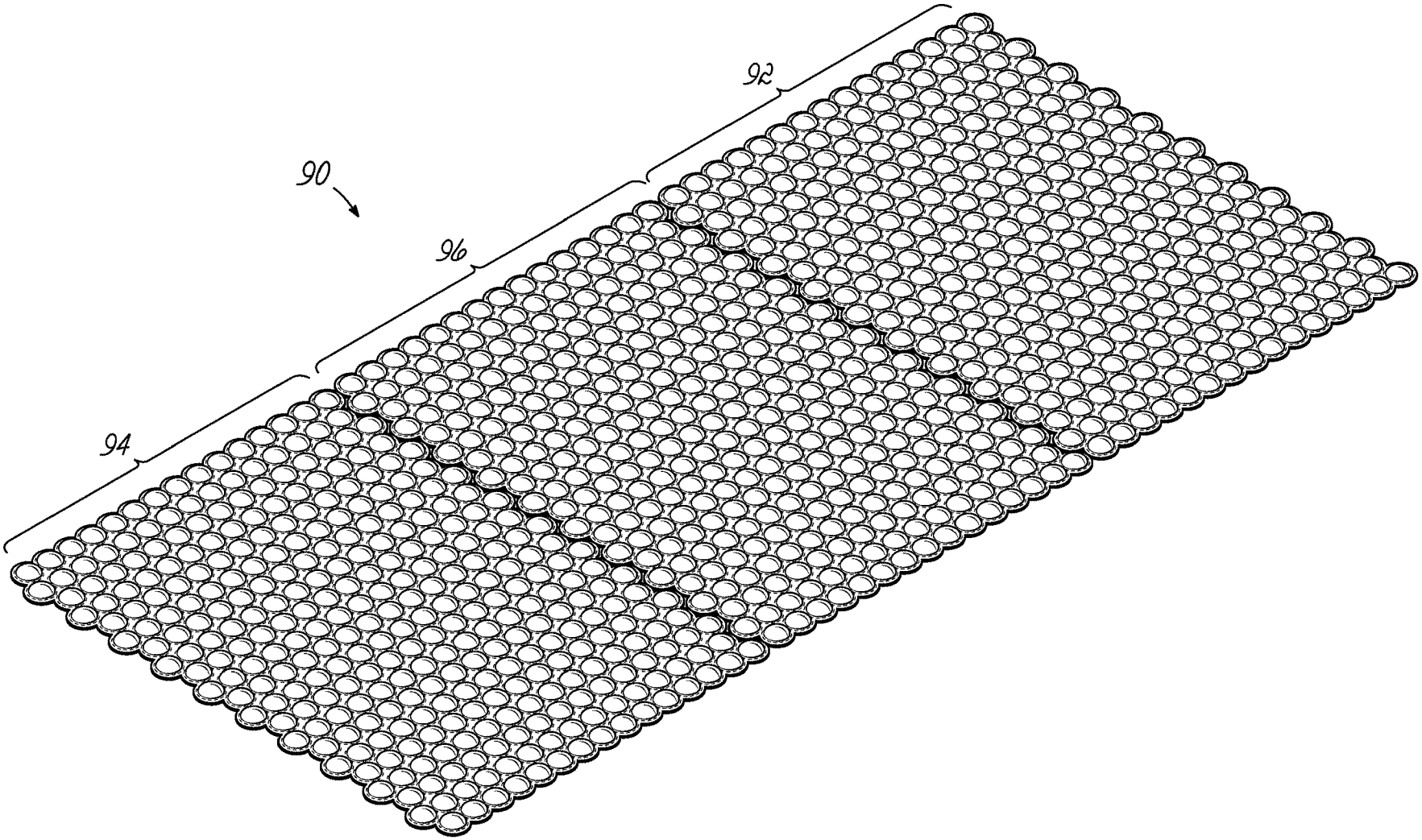
FIG. 9A is a perspective view of a posturized comfort layer.

FIG. 9A illustrates a posturized comfort layer 90 having three different areas or regions of firmness depending upon the materials within each of the areas or regions. The comfort layer 90 has a head section 92, a foot section 94 and a lumbar or middle section 96 therebetween. The size and number of segments in the seams, along with the types of materials used to construct the posturized comfort layer 90, may be selected so at least two of the sections may have a different firmness. For example, liquid pods 28 may be used in the head and foot sections 92, 94 and liquid pods 28' may be used in the lumbar or middle section 96. Although three sections are illustrated in FIG. 9A, any number of sections may be incorporated into a posturized comfort layer. Although each of the sections is illustrated being a certain size, they may be other sizes. The drawings are not intended to be limiting. Although FIG. 9A shows each of the segmented weld seams of comfort layer 90 being circular, a posturized comfort layer, such as the one shown in FIG. 9A, may have intersecting linear weld seams.

Figure 9B:
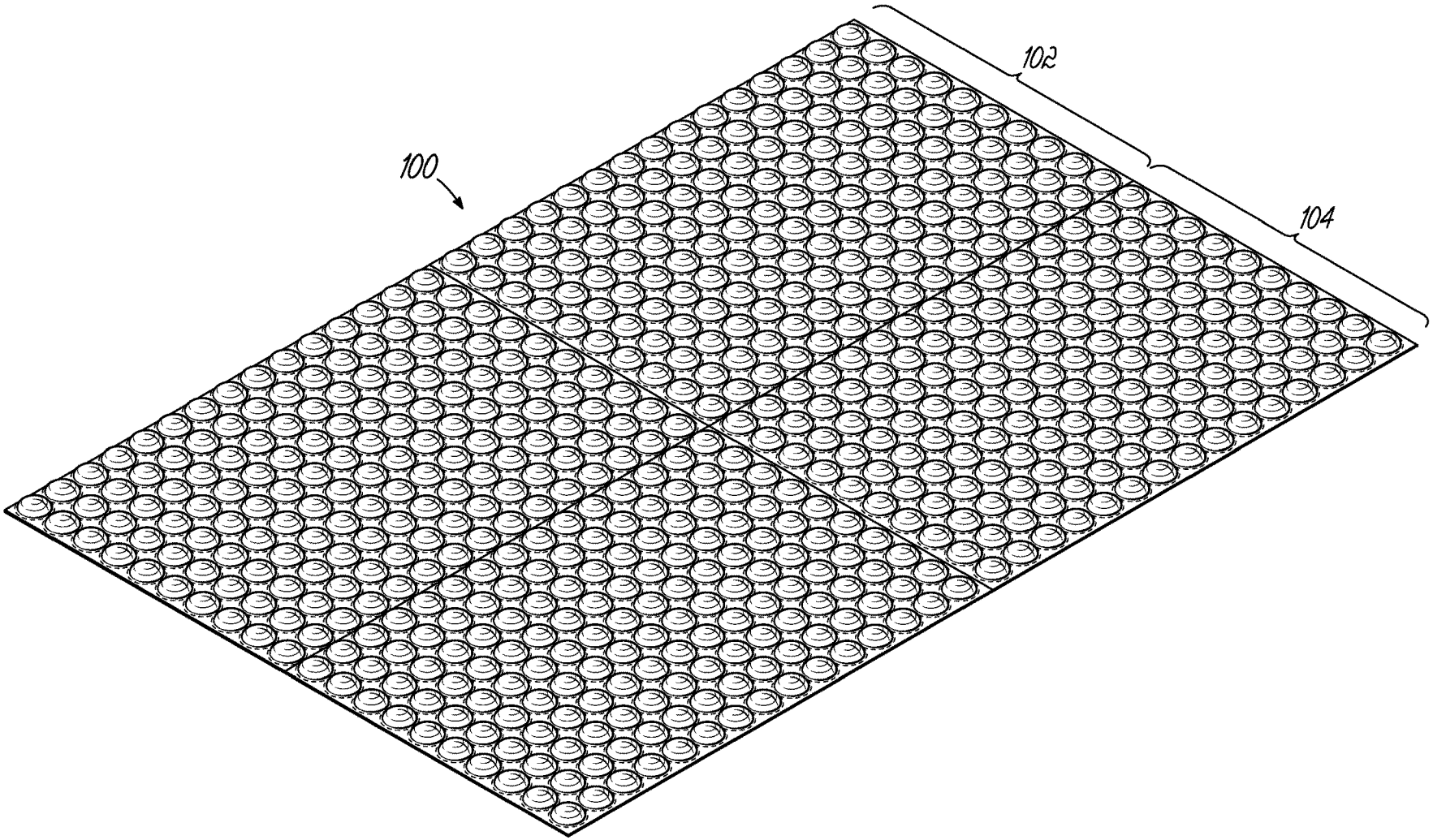
FIG. 9B is a perspective view of another posturized comfort layer.

FIG. 9B illustrates a posturized comfort layer 100 having two different areas or regions of firmness depending upon, among other things, the liquid pods within each of the areas or regions. The comfort layer 100 has a first section 102 and a second section 104. The size and number of segments in the weld seams, along with the type of materials used to construct the posturized comfort layer 100*a*, may be selected so at least two of the sections may have a different firmness. Although two sections are illustrated in FIG. 9B, any number of sections may be incorporated into a posturized comfort layer. Although each of the sections is illustrated being a certain size, they may be other sizes. The drawings are not intended to be limiting. Although FIG. 9B shows each of the segmented seams of comfort layer 100 being circular, a posturized comfort layer, such as the one shown in FIG. 9B, may have intersecting linear weld seams.

Figure 9C:
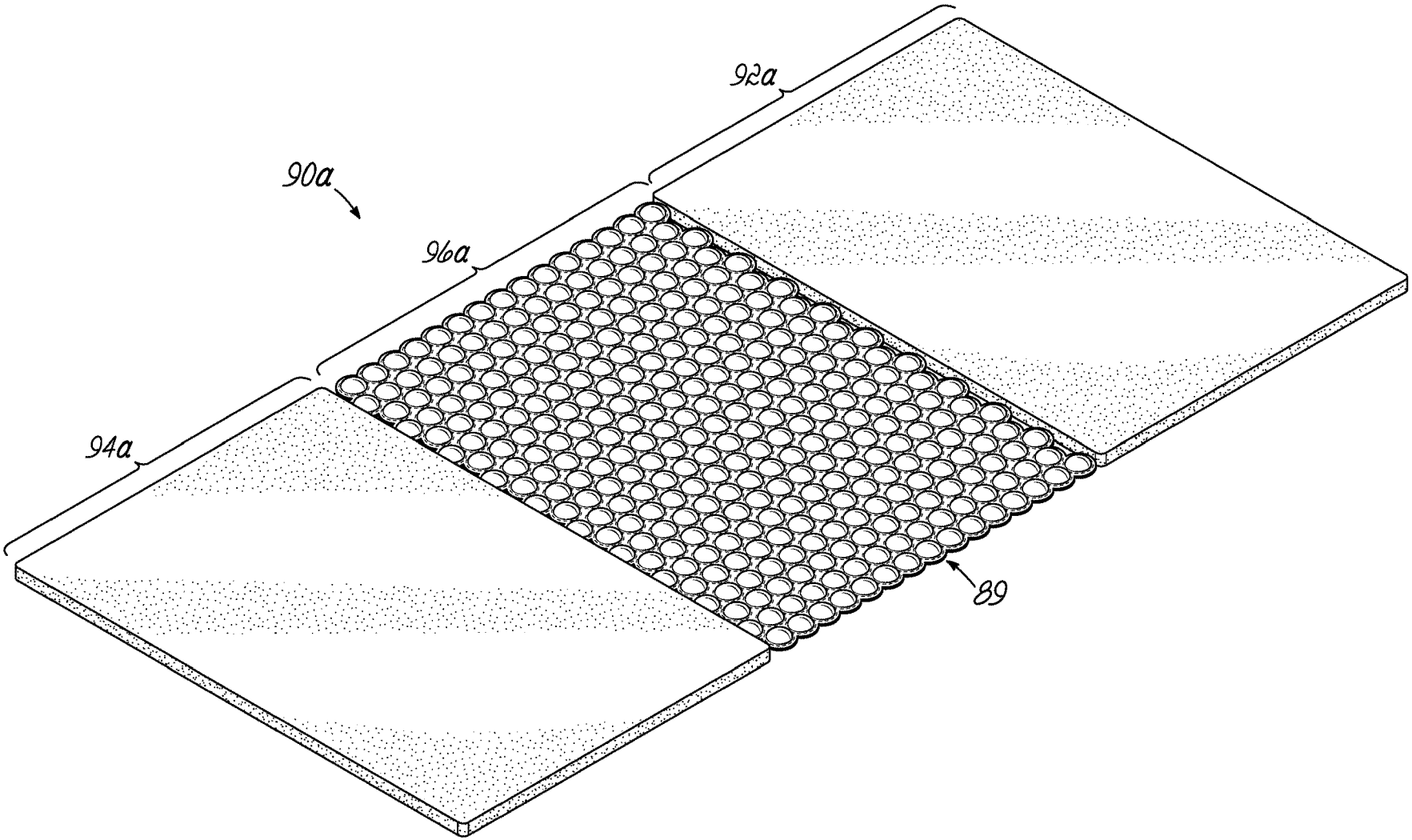
FIG. 9C is a perspective view of another posturized comfort layer.

FIG. 9C illustrates a posturized comfort layer 90*a* having three different areas or regions of firmness depending upon the materials within each of the areas or regions. The comfort layer 90*a* has a head section 92*a*, a foot section 94*a* and a lumbar or middle section 96*a* therebetween. The head and foot sections 92*a*, 94*a*, respectively, are made at least partially of foam while the lumbar or middle section 96*a* is a section of comfort layer 89 made with liquid pods 28, 28' in accordance with the present invention. Due to the types of material used to construct the posturized comfort layer 90*a*, at least two of the sections of the posturized comfort layer 90*a* may have a different firmness. Although three sections are illustrated in FIG. 9C, any number of sections may be incorporated into such a posturized comfort layer. Although each of the sections is illustrated being a certain size, they may be other sizes. The drawings are not intended to be limiting. Although FIG. 9C shows each of the segmented weld seams of the section of comfort layer 89 being circular, the section of comfort layer 89 shown in FIG. 9C, may have intersecting linear weld seams or solid weld seams of any desired shape.

Figure 9D:
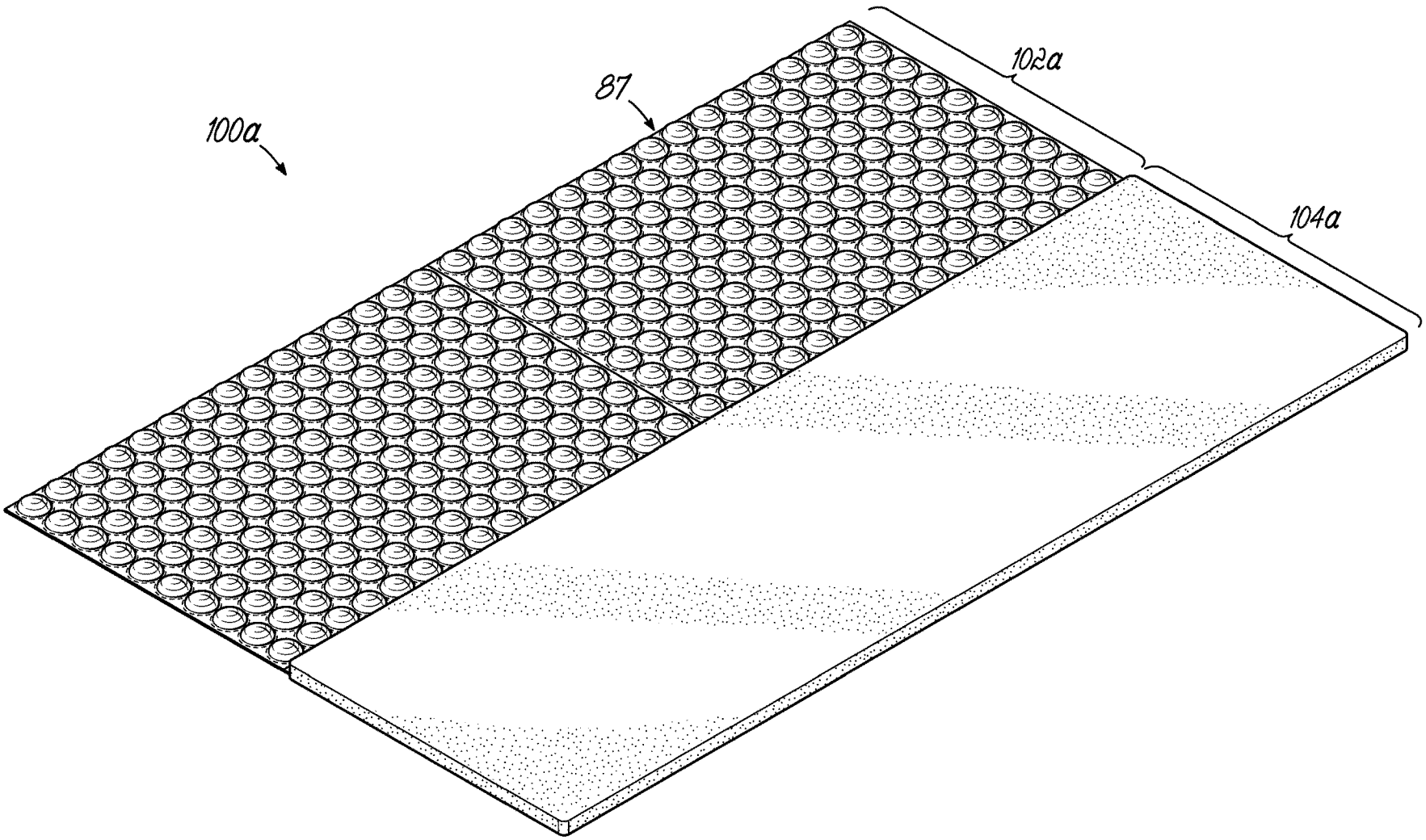
FIG. 9D is a perspective view of another posturized comfort layer.

FIG. 9D illustrates a posturized comfort layer 100*a* having two different areas or regions of firmness depending upon the materials within each of the areas or regions. The comfort layer 100*a* has a first section 102*a* made of a comfort layer piece 87 made with liquid pods 28, 28' in accordance with the present invention and a second section 104*a* made at least partially of foam. The types of materials used to construct the posturized comfort layer 100*a*, may be selected so at least two of the sections may have a different firmness. Although two sections are illustrated in FIG. 9D, any number of sections may be incorporated into such a posturized comfort layer. Although each of the sections is illustrated being a certain size, they may be other sizes. The drawings are not intended to be limiting. Although FIG. 9D shows each of the segmented seams of the first section 102*a* of comfort layer 100*a* being circular, the weld seams may alternatively be intersecting linear weld seams or solid weld seams of any desired shape.

Figure 9E:
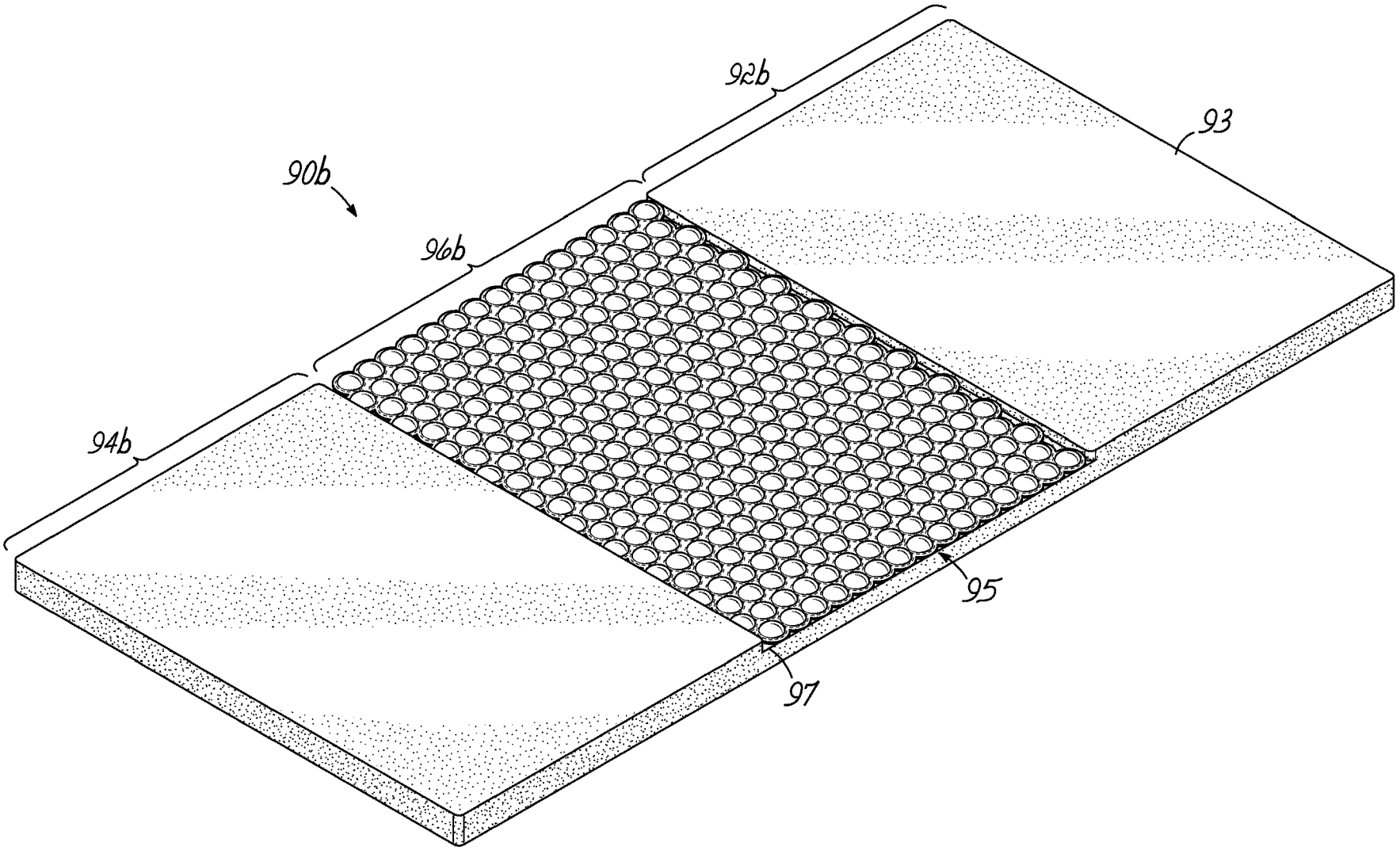
FIG. 9E is a perspective view of another posturized comfort layer.

FIG. 9E illustrates a posturized comfort layer 90*b* having three different areas or regions of firmness depending upon the materials within each of the areas or regions. The comfort layer 90*b* has a head section 92*b*, a foot section 94*b* and a lumbar or middle section 96*b* therebetween. The comfort layer 90*b* is made with one piece of foam 93 and one comfort layer piece 95. The piece of foam 93 is thicker in the head and foot sections 92*b*, 94*b* than in the middle section 96*b*. The head and foot sections 92*b*, 94*b*, respectively, are made from the piece of foam 93 while the lumbar or middle section 96*a* is made with a comfort layer piece 95 containing liquid pods residing or being located inside a cavity 97 in the piece of foam 93. Due to the types of material used to construct the posturized comfort layer 90*b*, at least two of the sections of the posturized comfort layer 90*b* may have a different firmness. Although three sections are illustrated in FIG. 9E, any number of sections may be incorporated into such a posturized comfort layer. Although each of the sections is illustrated being a certain size, they may be other sizes. The drawings are not intended to be limiting. Although FIG. 9E shows the weld seams of comfort layer piece 95 being circular, the weld seams may alternatively be intersecting linear weld seams. Any type of weld seam may be incorporated into the comfort layer piece 95.

Figure 9F:
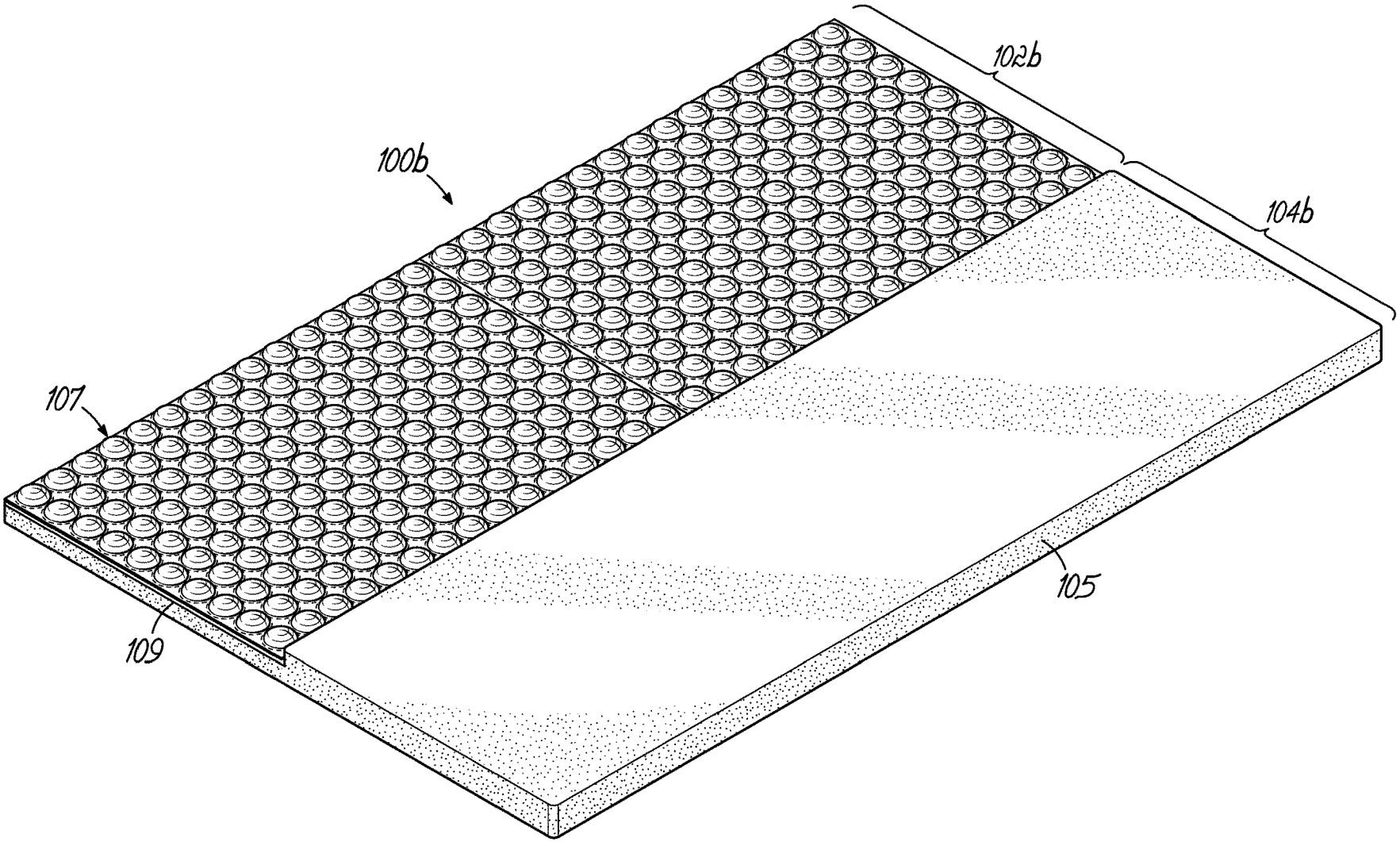
FIG. 9F is a perspective view of another posturized comfort layer.

FIG. 9F illustrates a posturized comfort layer 100*b* having two different areas or regions of firmness depending upon the materials within each of the areas or regions. The comfort layer 100*b* has a first section 102*b* and a second section 104*b*. The comfort layer 100*b* is made with one piece of foam 105 and one comfort layer piece 107. The piece of foam 105 is thicker in the second section 104*b* than in the first section 102*b*. The comfort layer piece 107 containing liquid pods resides in a cavity 109 in the piece of foam 105 in the first section 102*b* of posturized comfort layer 100*b*. The types of materials used to construct the different sections of posturized comfort layer 100*b* may be selected so at least two of the sections may have a different firmness. Although two sections are illustrated in FIG. 9F, any number of sections may be incorporated into such a posturized comfort layer. Although each of the sections is illustrated being a certain size, they may be other sizes. The drawings are not intended to be limiting. Although FIG. 9F shows each of the segmented seams of comfort layer piece 107 being circular, the comfort layer piece 107 may have intersecting linear weld seams. Any type of weld seam may be incorporated into the comfort layer piece 107.

Figure 10A:
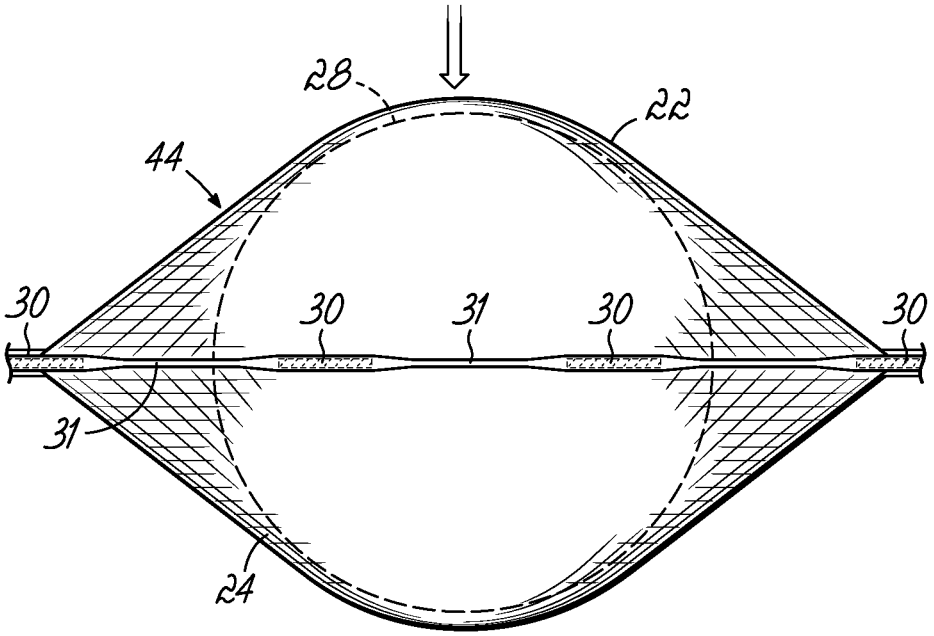
FIG. 10A is a detailed cross-sectional view taken along a portion of the line 4A-4A of FIG. 4.

FIG. 10A shows one pocket 44 of the comfort layer 16 without any load placed on the pocket 44. The pocket 44 is in a relaxed condition. Air is not flowing through the gaps 31 of the weld seams 30 of pocket 44. The air pressure inside the pockets 44 is at atmospheric pressure at ambient temperature so the gaps or valves 31 are in a relatively restrictive state, i.e. relatively flat. The opposed plies 22, 24 of fabric of the gaps 31 of weld seams 30 may be contacting each other or very close to each other. See FIG. 10A.

Figure 10B:
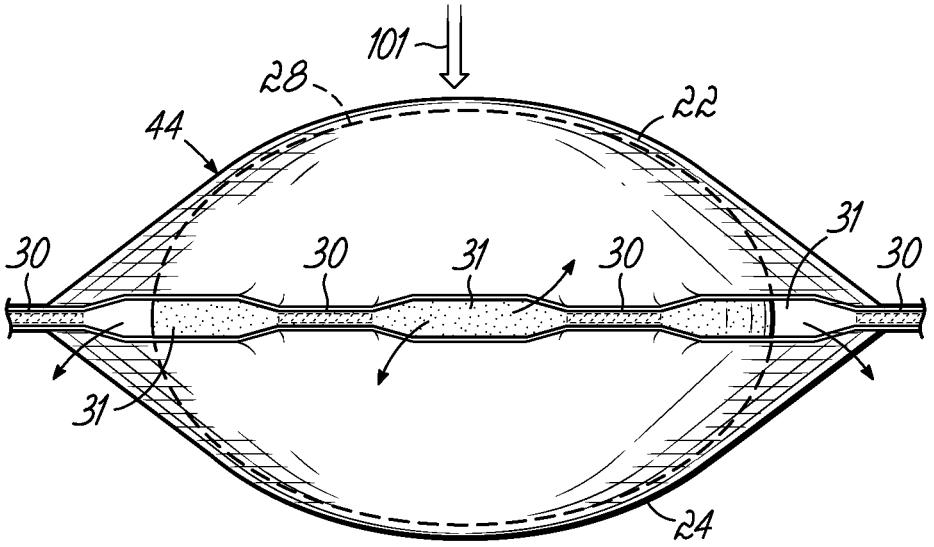
FIG. 10B is a detailed cross-sectional view of the pocketed liquid pod of FIG. 10A under a load.

FIG. 10B shows the pocket 44 with a load placed on the pocket 44, as indicated by arrow 101. Once a load is placed on the pocket 44, at least some of the valves or gaps 31 of the weld seams 30 surrounding the pocket 44 open slightly so that air flows through at least some of the gaps 31 of the weld seams 30 of pocket 44. The same is true with any of the pockets with segmented seams shown or described herein.

Figure 11:
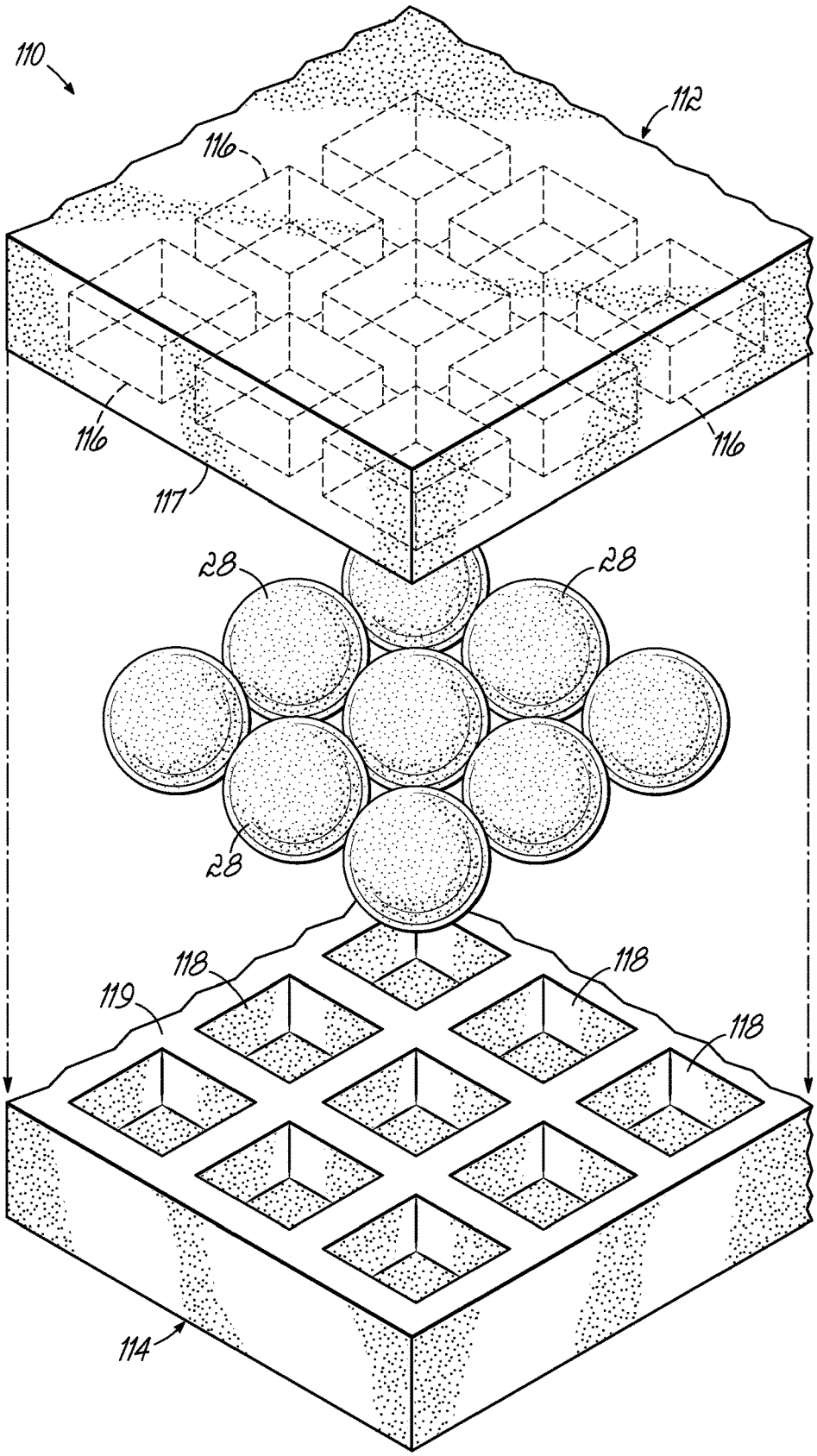
FIG. 11 is a partially disassembled view of a portion of another embodiment of comfort layer having liquid pods.
Figure 12A:
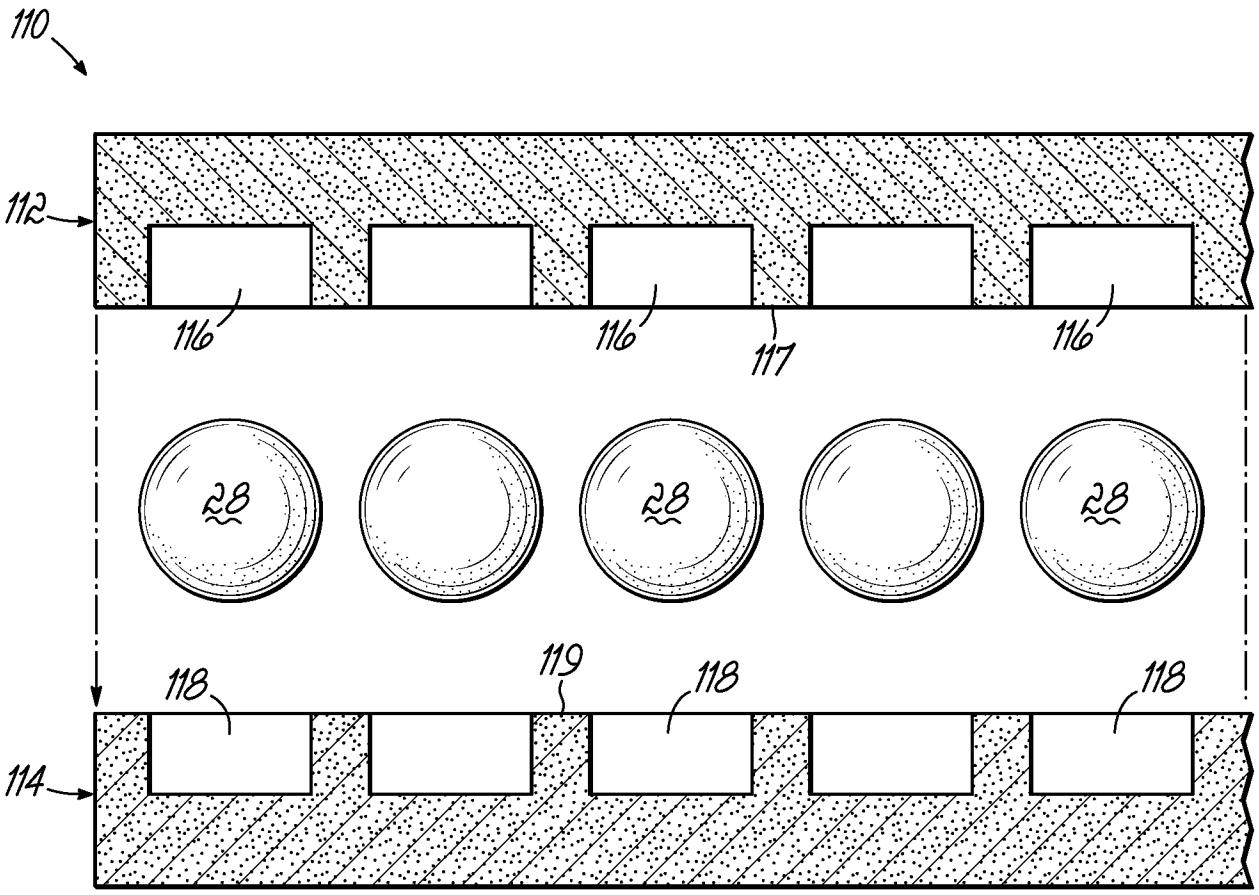
FIG. 12A is a side elevational view of a portion of the comfort layer of FIG. 11 being assembled.
Figure 12B:
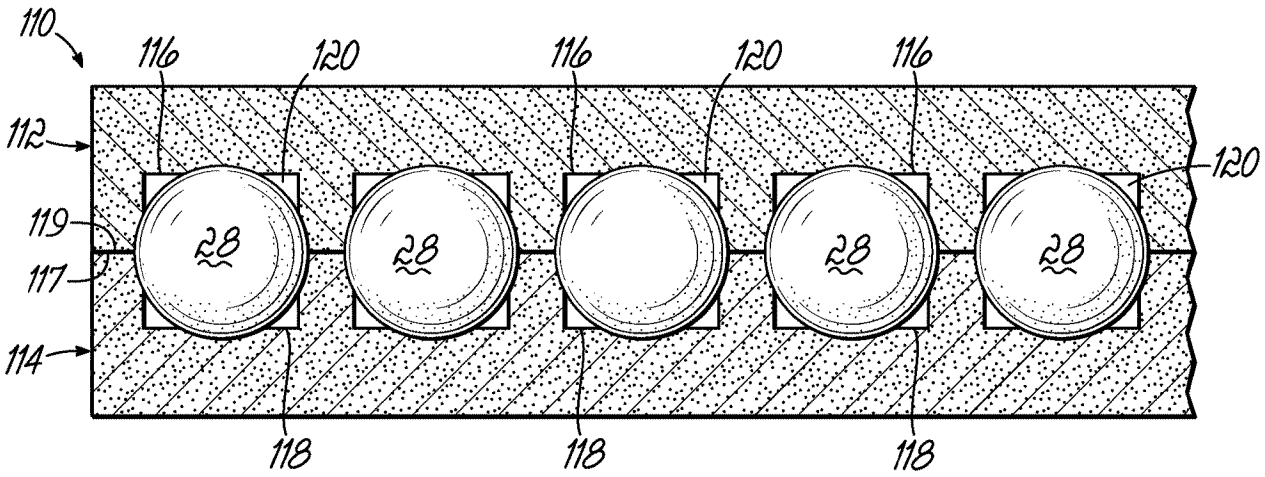
FIG. 12B is a side elevational view of the portion of the comfort layer of FIG. 11 assembled.

FIGS. 11 and 12A show a method of making a comfort layer 110 shown in FIG. 12B. Comfort layer 110 comprises a first or upper piece of foam 112, a second or lower piece of foam 114 and a plurality of liquid pods 28. The first piece of foam 112 has a plurality of cutouts 116 extending upwardly from a lower surface 117 of the first piece of foam 112. The second piece of foam 114 has a plurality of cutouts 118 extending downwardly from an upper surface 119 of the second piece of foam 114. As shown in FIGS. 12A and 12B, the cutouts 116, 118 are aligned to create receptacles 120 when the first and second pieces of foam 112, 114 are joined together with adhesive or any other known method. As shown in FIG. 12B, when the first and second pieces of foam 112, 114 are joined together to create comfort layer 110, the lower surface 117 of the first piece of foam 112 abuts or contacts the upper surface 119 of the second piece of foam 114. As shown in FIG. 12B, a liquid pod 28 is located in each receptacle 120. Although not shown, liquid pods 28' may alternatively be located in receptacles 120. Although not shown, some of the receptacles 120 may be empty.

The present invention is not intended to be limited to the size of receptacles 120 or size of liquid pods 28 shown in the drawings. The drawings are not intended to be limiting.

Figure 13:
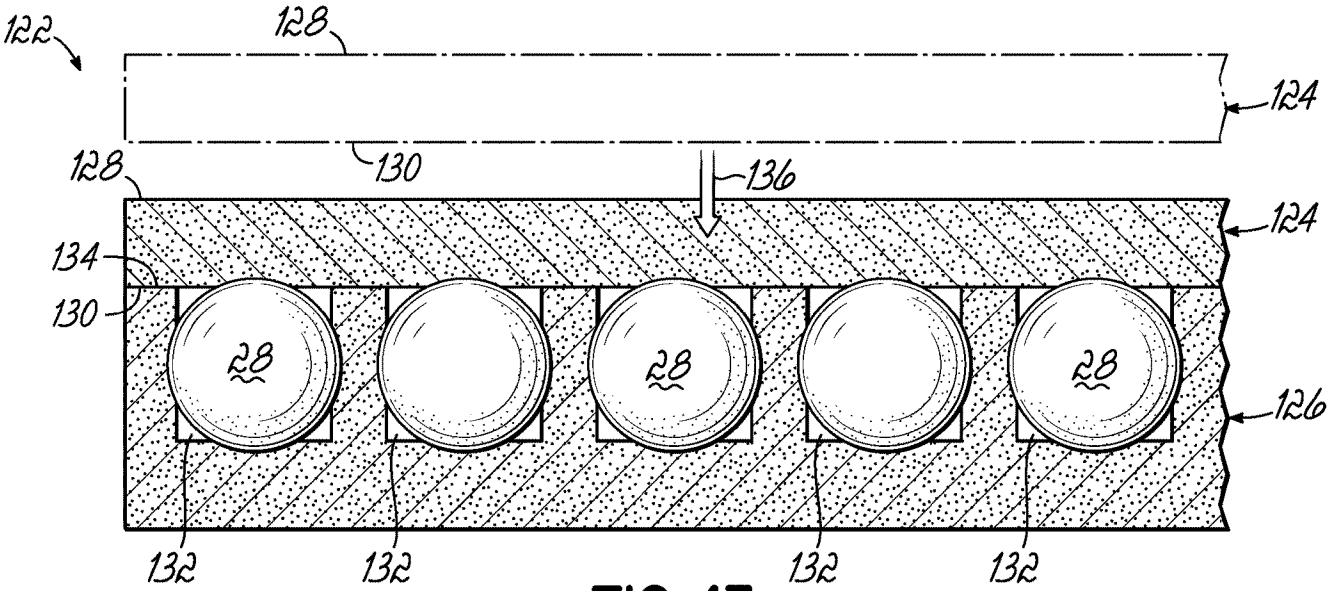
FIG. 13 is a side elevational view of a portion of another comfort layer having liquid pods being assembled.

FIG. 13 illustrates an alternative comfort layer 122 comprising a first or upper piece of foam 124, a second or lower piece of foam 126 and a plurality of liquid pods 28. The first piece of foam 124 has an upper surface 128 and a lower surface 130, the linear distance between which defines the height of the first piece of foam 124. The second piece of foam 126 has a plurality of cutouts 132 extending downwardly from an upper surface 134 of the second piece of foam 126. As shown in FIG. 13, the first piece of foam 124 is lowered as indicated by arrow 136 until the lower surface 130 of the first piece of foam 124 abuts or contacts the upper surface 134 of the second piece of foam 126. The first and second pieces of foam 124, 126 are joined together with adhesive or any other known method. As shown in FIG. 13, a liquid pod 28 is located in each cutout 132. Although not shown, liquid pods 28' may alternatively be located in cutouts 132. Although not shown, some of the cutouts 132 may be empty. Although not shown, the generally planar piece of foam may be underneath the piece of foam having cutouts with liquid pods therein.

The present invention is not intended to be limited to the size of cutouts 132 or size of liquid pods 28 shown in the drawings. The drawings are not intended to be limiting.

While we have described several preferred embodiments of this invention, persons skilled in this art will appreciate that any time a liquid pod 28 is referenced in this document, a liquid pod 28' may be substituted for liquid pod 28 and visa-versa. Similarly, any known permeable, semi-impermeable or non-permeable fabric materials may be utilized in this invention. Similarly, such persons will appreciate that each pocket may contain any number of liquid pods, made of any desired material. Therefore, we do not intend to be limited except by the scope of the following appended claims.

What is claimed is:

1. A comfort layer configured to overlay a core of a bedding or seating cushion product, said comfort layer comprising:

a matrix of liquid pods, each liquid pod of which is contained within a pocket of fabric between first and second plies of fabric, each of said plies of fabric comprising at least one layer, each pocket having segmented seams joining the first and second plies of fabric with gaps between adjacent segments configured to allow air to pass through the gaps;

wherein each of said liquid pods comprises a pouch made of a hydrophobic membrane, the pouch surrounding a volume of liquid and surrounding a plurality of hydrogel beads, wherein the plurality of hydrogel beads are contained within the pouch, such that upon compression of the liquid pods air exits the pockets in which the liquid pods reside to affect the feel of the comfort layer.

2. The comfort layer of claim 1 wherein the hydrogel beads constitute natural polymeric materials.

3. The comfort layer of claim 1 wherein the pouch is made of rubber.

4. The comfort layer of claim 1 wherein the pouch is made of plastic.

5. The comfort layer of claim 1 wherein the pouch is made at least partially of renewable material.

6. The comfort layer of claim 1 wherein the hydrogel beads constitute a group of synthetic polymeric materials.

7. A comfort layer configured to overlay a core of a bedding or seating product, said comfort layer comprising:

liquid pods, each of the liquid pods comprising a pouch made of a hydrophobic membrane, the pouch filled with a phase change material which is solid at room temperature but which turns to liquid when heat is absorbed by the phase change material from a person laying on the product;

a first ply of fabric on one side of the liquid pods; and a second ply of fabric on another side of the liquid pods, the first and second plies of fabric being joined with segmented seams around each of the liquid pods to create individual pockets which contain the liquid pods, the segmented seams having gaps between adjacent segments configured to allow air to pass through the gaps, wherein upon compression of the liquid pods air exits the pockets in which the liquid pods reside and exits the comfort layer to affect the feel of the comfort layer.

8. The comfort layer of claim 7 wherein the pouches are made of rubber.

9. The comfort layer of claim 7 wherein the pouches are made of plastic.

10. The comfort layer of claim 7 wherein the pouches are made of vinyl.

11. The comfort layer of claim 7 wherein the phase change material is an organic phase change material.

12. The comfort layer of claim 7 wherein the phase change material is a non-organic phase change material.

13. The comfort layer of claim 7 wherein the phase change material comprises fatty acids.

14. A comfort layer configured to overlay a core of a bedding or seating product, said comfort layer comprising:

liquid pods, each of the liquid pods comprising a pouch made of a hydrophobic membrane, the pouch filled with a phase change material which is solid at room temperature but which turns to liquid when heat is absorbed by the phase change material from a person laying on the product;

a first ply of fabric on one side of the liquid pods; and a second ply of fabric on another side of the liquid pods, the first and second plies of fabric being joined with segmented seams around each of the liquid pods to create individually pocketed liquid pods, the segmented seams having gaps between adjacent segments configured to allow air to pass through the gaps, wherein upon compression of the liquid pods air exits the individual pockets and the amount of air exiting the comfort layer affects the feel of the individually pocketed liquid pods of the comfort layer.

15. The comfort layer of claim 14 wherein the pouches are made of rubber.

16. The comfort layer of claim 14 wherein the pouches are made of plastic.

17. The comfort layer of claim 14 wherein the pouches are made of vinyl.

18. The comfort layer of claim 14 wherein the phase change material is an organic phase change material.

19. The comfort layer of claim 14 wherein the phase change material is a non-organic phase change material.

20. The comfort layer of claim 14 wherein the phase change material comprises fatty acids.

* * * * *